US008733623B2

(12) United States Patent
Beales et al.

(10) Patent No.: US 8,733,623 B2
(45) Date of Patent: May 27, 2014

(54) CARRYING HANDLE FOR A CARTON

(75) Inventors: Jonathan T. Beales, Smyrna, GA (US); Aaron L. Bates, Moseley, VA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 1007 days.

(21) Appl. No.: 12/808,573

(22) PCT Filed: Dec. 22, 2008

(86) PCT No.: PCT/US2008/087960

§ 371 (c)(1),
(2), (4) Date: Jul. 25, 2011

(87) PCT Pub. No.: WO2009/082724

PCT Pub. Date: Jul. 2, 2009

(65) Prior Publication Data

US 2012/0085814 A1 Apr. 12, 2012

Related U.S. Application Data

(60) Provisional application No. 61/087,138, filed on Aug. 7, 2008, provisional application No. 61/051,333, filed on May 7, 2008, provisional application No. 61/016,552, filed on Dec. 24, 2007.

(51) Int. Cl.
*B65D 5/468* (2006.01)

(52) U.S. Cl.
USPC ..... 229/117.13; 229/920; 206/141; 206/161

(58) Field of Classification Search
USPC ..... 229/117.13, 117.14, 117.16, 920; 206/141, 161, 427
See application file for complete search history.

(56) References Cited

U.S. PATENT DOCUMENTS

| | | | | | |
|---|---|---|---|---|---|
| 2,414,854 | A | * | 1/1947 | Conescu | 229/182 |
| 4,706,876 | A | * | 11/1987 | Wilson | 229/117.13 |
| 4,728,026 | A | * | 3/1988 | Schuster | 229/117.13 |
| 4,784,316 | A | | 11/1988 | Crouch | |
| 4,785,991 | A | * | 11/1988 | Schuster | 229/117.13 |
| 4,966,324 | A | | 10/1990 | Steel | |
| 4,974,771 | A | * | 12/1990 | Lavery | 229/117.13 |
| 5,106,014 | A | * | 4/1992 | Miller | 229/117.13 |
| 5,222,658 | A | * | 6/1993 | DeMaio et al. | 229/117.13 |
| 6,021,898 | A | | 2/2000 | Sutherland | |
| 6,237,839 | B1 | * | 5/2001 | Brown | 229/117.13 |
| 6,902,104 | B2 | * | 6/2005 | Holley et al. | 229/242 |
| 7,367,453 | B2 | * | 5/2008 | Sutherland | 206/427 |
| 2006/0081492 | A1 | * | 4/2006 | Holley et al. | 206/427 |

(Continued)

FOREIGN PATENT DOCUMENTS

EP 1888412 B1 8/2010

*Primary Examiner* — Gary Elkins
*Assistant Examiner* — Scott McNurlen
(74) *Attorney, Agent, or Firm* — MWV Intellectual Property Group

(57) ABSTRACT

A carton (12) includes a first wall (22) and a second wall (20). The first wall (22) includes a first edge (21) and a second edge (23) that are opposed to one another. The first wall (22) and the second wall (20) are adjoined along the first edge (21). The carton (12) includes a handle (30). The handle (30) includes a handle opening (80) that is elongated along a longitudinal axis that extends transversely to the first edge (21). The handle opening (80) is configured to be engaged no closer to the second edge (23) than to the first edge (21).

18 Claims, 15 Drawing Sheets

(56) References Cited

U.S. PATENT DOCUMENTS

2007/0017962 A1 1/2007 Russ
2011/0233091 A1* 9/2011 Block et al. ..... 206/427
2012/0312866 A1* 12/2012 Walling et al. ..... 229/117.12

* cited by examiner

CARRYING HANDLE FOR A CARTON

CROSS REFERENCE TO RELATED APPLICATIONS

This application claims priority to U.S. Provisional Application No. 61/016,552, filed Dec. 24, 2007, U.S. Provisional Application No. 61/051,333, filed May 7, 2008, and U.S. Provisional Application No. 61/087,138, filed Aug. 7, 2008, the entirety of which are incorporated herein by reference.

TECHNICAL FIELD

This disclosure relates generally to cartons and, more specifically, to cartons with offset handles.

BACKGROUND

Carton manufacturers often face the challenge of providing a carton having ergonomic handle openings that are sufficiently strong to withstand the stress generated by the weight of articles enclosed. There is a continuing need for improved handle configurations that are stronger and provide a carton manufacturer savings such as with the lessened amount of material that is needed when a carton has a more robust handle. Therefore, a heretofore unaddressed need exists in the industry to address the aforementioned deficiencies and inadequacies.

SUMMARY

The various embodiments of the present disclosure overcome the shortcomings of the prior art by providing a handle opening that is offset with respect to a medial plane of the carton.

According to an exemplary embodiment, a carton includes a plurality of walls including a first wall and a second wall. The first wall includes a first edge and a second edge that are opposed to one another. The first wall and the second wall are adjoined along the first edge. The carton includes a handle. The handle includes a handle opening in the first wall and, in certain embodiments, in the second wall. The handle opening is elongated along a longitudinal axis that extends transversely with respect to the first edge. The handle opening is configured to be engaged no closer to the second edge than to the first edge.

A notional medial plane can be defined as substantially equidistant from the first edge and the second edge and substantially perpendicular to the first wall. The handle is offset with respect to the notional medial plane. Alternatively, described the ends of the handle are not substantially equidistant to the notional medial plane or otherwise the notional medial plane does not substantially bisect the handle.

In embodiments where the handle is disposed in the first wall, the handle opening can include a first end and a second end where a distance between the first end and the first edge is less than a distance between the second end and the second edge. In various embodiments, the handle opening extends from the first edge to a position on the first wall that is offset from the second edge.

In embodiments where the handle is disposed in the first wall and the second wall, the handle opening can be formed in the first wall and the second wall so as to interrupt the first edge. In various embodiments, the handle opening includes a first end and a second end and the second end is offset from the second edge.

According to an exemplary embodiment, the handle includes a handle flap that is hingedly connected to an edge of the handle opening so as to be connected to both the first wall and the second wall. The handle flap is configured to fold inwardly. The handle flap includes a web structure that is configured to facilitate folding the handle flap. The handle flap includes a first wall section that is hingedly connected to the first wall and a second wall section that is hingedly connected to the second wall. The first wall section is hingedly connected to the second wall section along the first edge. Either or both of the first wall section and the second wall section can include a fold line extending at an angle with respect to the first edge to define a web that facilitates folding the first section with respect to the second section as the handle flap is inwardly folded.

In certain of the embodiments, the handle includes a stress relief feature formed adjacent the first end and/or the second end of the handle. An exemplary stress relief feature can include a severance line that extends from the second end to the second edge. In various embodiments, the carton includes a third wall that is adjoined to the first wall along the second edge and the severance line further extends onto the third wall from the second edge. In various embodiments, the stress relief feature includes an arcuate severance line that is concentric with an end of the handle opening or an undulating severance line.

In various embodiments, the handle opening is tapered along the longitudinal axis so as to widen towards the first edge.

The carton is configured to package a group of cylindrical articles arranged in rows and columns. Each article includes opposed ends and a side wall with a longitudinal axis aligned with the opposed ends. The first wall is disposed adjacent the sidewalls of a row of articles and the second wall is disposed adjacent a first end of each of the articles. The handle opening is configured to overlie the space between sidewalls of two adjacent articles.

The foregoing has broadly outlined some of the aspects and features of the present disclosure, which should be construed to be merely illustrative of various potential applications. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

DETAILED DESCRIPTION

Figure 1:
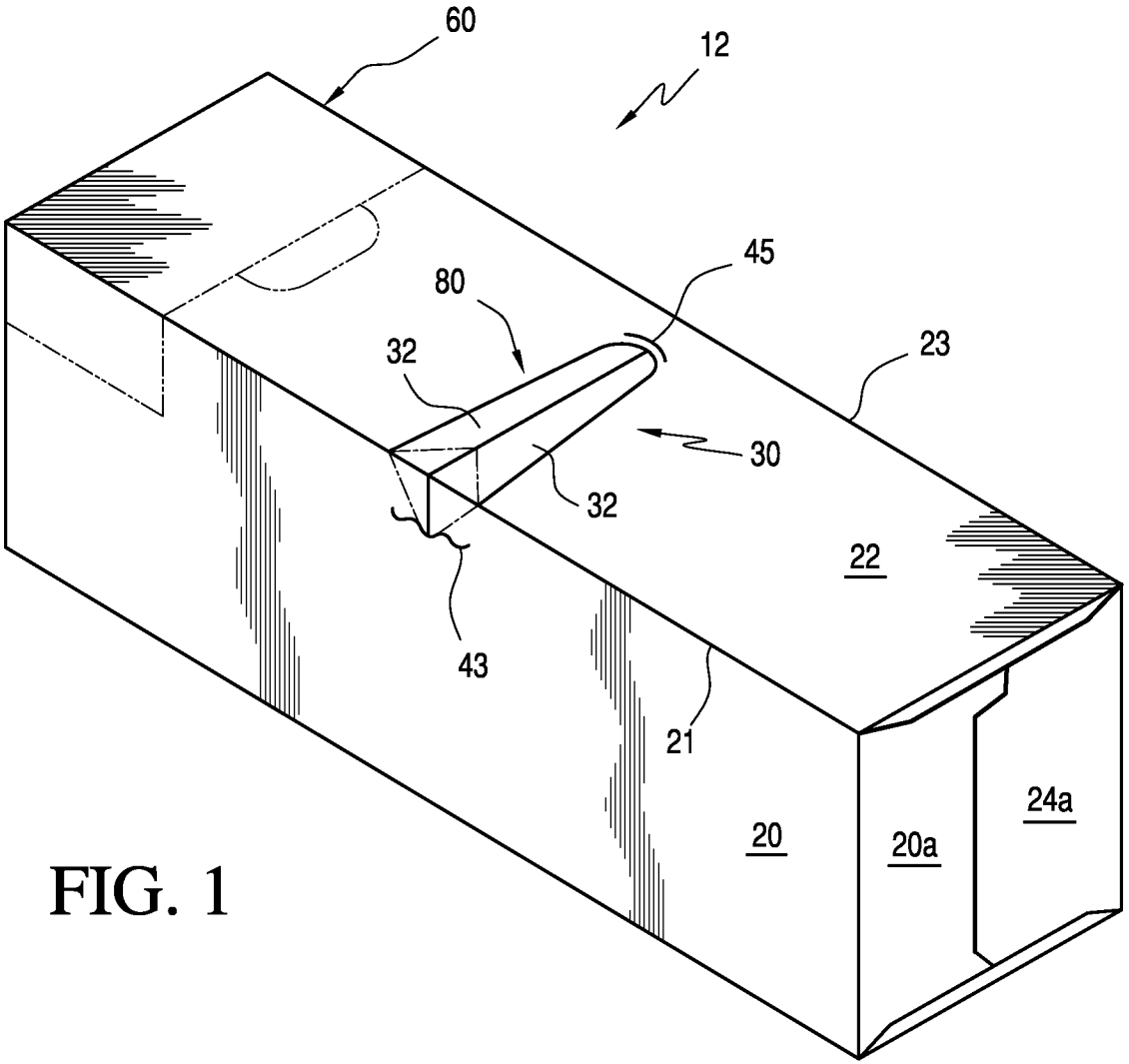
FIG. 1 is a perspective view of a carton that includes a handle, according to a first exemplary embodiment.

As required, detailed embodiments are disclosed herein. It must be understood that the disclosed embodiments are merely exemplary and that the teachings of the disclosure may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the disclosure. Therefore, specific structural and functional details disclosed herein are not to be interpreted as limiting, but merely as a basis for the claims and as a representative basis for teaching one skilled in the art.

As an overview, the disclosure teaches an offset handle for carrying a carton for packaging articles. The handle can be formed in a first wall of the carton. In various embodiments, the handle is additionally formed in an adjacent second wall of the carton. Rather than being symmetrically disposed in the carton, the carrying handle is offset with respect to a line or plane of symmetry of the carton. Because the handle is offset in the first wall, when the carton is grasped, the carton lists, or leans, to one side optimally directing stress forces throughout the supporting wall structures.

The handle is suited for cartons that package cylindrical articles such as beverage cans. The handle can be positioned to overlie the space that is between adjacent cans (or other cylindrical articles) and adjacent the first carton wall.

In various embodiments, the handle includes a flap that is folded inwardly to provide a handle opening. The flap can be formed in the first wall and the second wall. In such embodiments, the flap is configured to fold inwardly. For example, the flap can include a web structure that facilitates folding a top wall portion of the handle flap with respect to a side wall portion of the handle flap as the handle flap is folded inwardly.

Referring now to the drawings, wherein like numerals indicate like elements throughout the several views, the drawings illustrate certain of the various aspects of exemplary embodiments.

Referring first to FIGS. 1, and 4-6, therein is illustrated in a perspective view of an exemplary embodiment of a carton 12 having a handle 30. The perspective view of FIG. 1 shows a first side wall 20 and a top wall 22 in which the handle 30 is integrally formed. The first side wall 20 and top wall 22 are foldably adjoined along a fold line 21. An end of the carton 12 that is closed with overlapping side end flaps 20*a*, 24*a* is illustrated in FIG. 1. A severance line or cut line 45 with an arced configuration is disposed between a first end of the handle 30 and the proximate side-wall edge (fold line 23 of FIG. 3). The arced configuration of the interposed cut line 45 is substantially concentric with the curvilinear end of the handle 30 formed by curvilinear severance line or slit 33 (see FIG. 3). A dispenser 60 is generally illustrated also.

Figure 2:
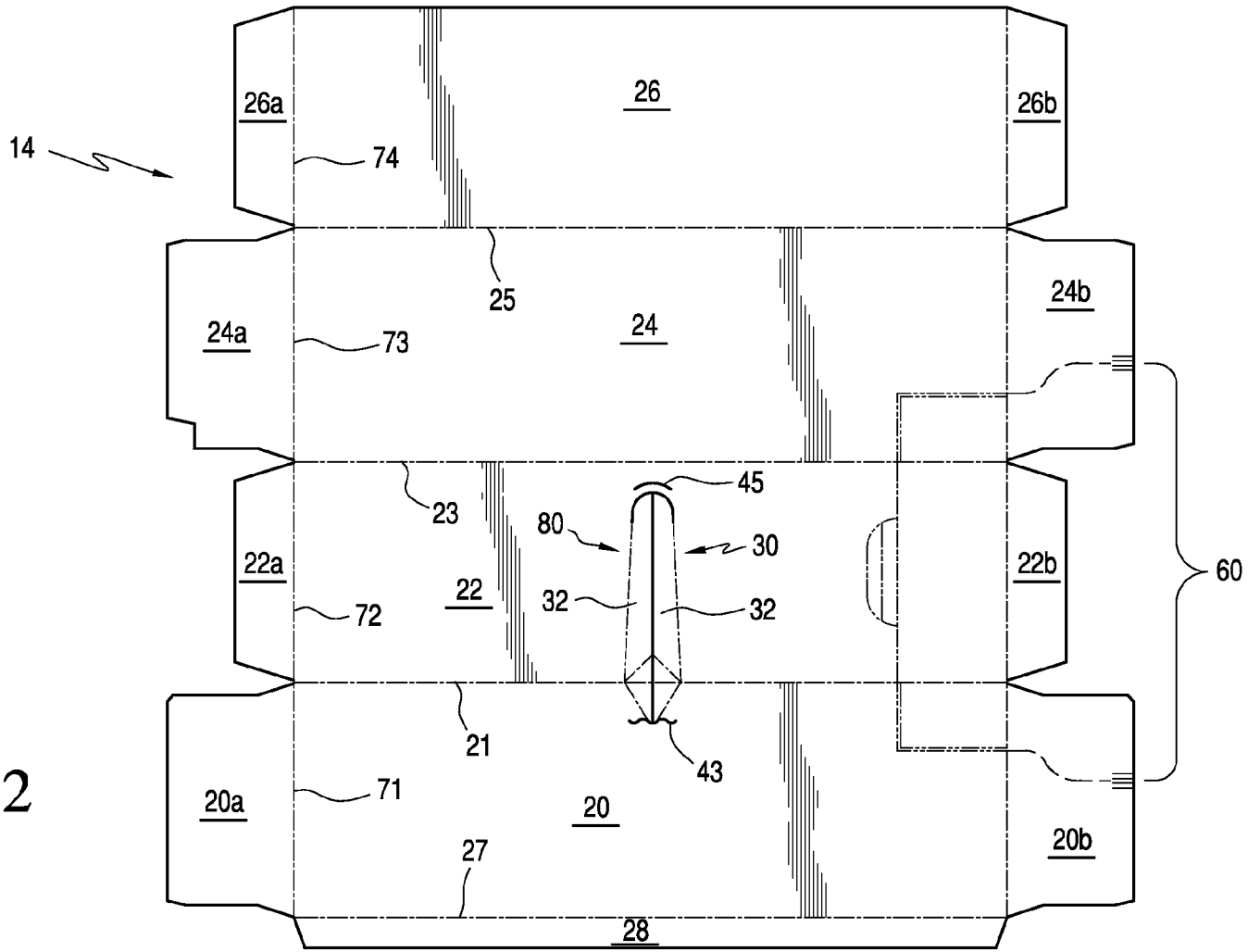
FIG. 2 is a plan view of a blank suitable for forming the carton of FIG. 1.
Figure 3:
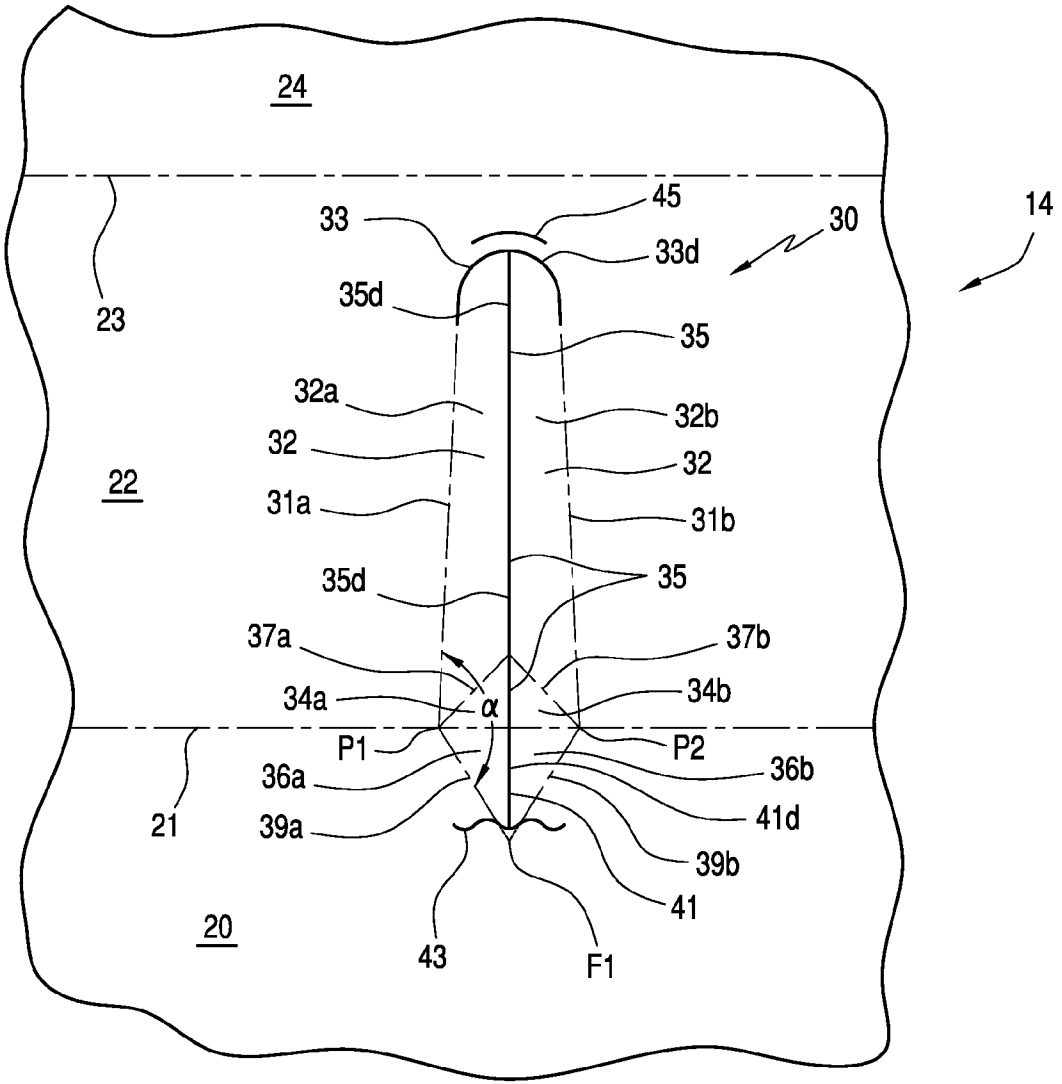
FIG. 3 is an enlarged, fragmentarily-illustrated portion of the blank of FIG. 2 that includes a carrying handle.

Reference is now made to FIGS. 2 and 3, which is a plan view of a blank 14 suitable for forming the carton 12. The blank 14 is illustrated from an inner surface, whereas the carton 12 illustrated in FIG. 1 depicts the reverse (outer) surface of the blank 14 of FIG. 2. The blank 14 includes a series of panels that are foldably adjoined to one another along fold lines. The panels can be arranged to form the walls of the carton 12. For clarity, a panel that forms a wall and the wall itself are designated with like numerals.

A first side wall panel 20 is foldably adjoined to a top wall panel 22 along fold line 21. A second side wall panel 24 is foldably adjoined to the top wall panel 22 along fold line 23. A bottom wall panel 26 is foldably adjoined to the second side wall panel 24 along fold line 25. An auxiliary panel 28 disposed for attachment of the first side wall panel 20 to the bottom wall panel 26 to form the tubular structure for the carton of FIG. 1 is foldably adjoined to the first side wall panel 20 along fold line 27.

Various end flaps are disposed for forming end closures of the open ends of the tubular structure or otherwise the end walls of the carton 12. Side end flaps 20*a*, 20*b* are foldably adjoined at respective opposing ends of the first side wall panel 20, top end flaps 22*a*, 22*b* are foldably adjoined at respective opposing ends of the top wall panel 22, side end flaps 24*a*, 24*b* are foldably adjoined at respective opposing ends of the second side wall panel 24, and bottom end flaps 26*a*, 26*b* are foldably adjoined at respective opposing ends of the bottom wall 26. A handle 30 is integrally formed predominantly in the top wall panel 22 and partially in the first side wall panel 20. The cut line 45 is disposed between an end of the handle 30 and the fold line 23 that defines the intersection and line of joinder of the top wall panel 22 with the second side wall panel 24. The arced configuration of the interposed cut line 45 is substantially concentric with the curvilinear end of the handle 30 formed by slit 33 (see FIG. 3). For reference purposes, the fold line 21 between the top wall panel 22 and the first side wall panel 20 can be considered a first edge of the top wall 22, and the fold line 23 between the top wall panel 22 and the second side wall panel 24 can be considered a second edge of the top wall 22. The features of the handle 30 will be described in greater detail below with reference to FIG. 3. The dispenser 60 is defined by frangible lines extending along end portions of the top wall panel 22, side wall panels 20, 24 and side end flaps 20*b*, 24*b*.

Referring now to FIG. 3, therein is shown in an enlarged plan view the handle 30. The handle 30 is shown as integrally formed in portions of the top wall panel 22 and first side wall panel 20. Partial portions of the first side wall panel 20, top wall panel 22 and second side wall panel 24 are shown in FIG.

3. The handle 30 includes an elongated handle opening or slot 80 that is formed in the top wall panel 22 and first side wall panel 20. The slot 80 may be initially occupied and subsequently vacated by a pair of pivotable handle flaps 32 including primary handle flap portions 32*a*, 32*b* and webs associated therewith.

The slot 80, and, in turn, the primary handle flap portions 32*a*, 32*b*, are formed in part by top wall fold lines 31*a*, 31*b*. The top wall fold lines 31*a*, 31*b* are a pair of opposing weakened lines that extend substantially, but not entirely, across the width of the top wall panel 22. The top wall fold lines 31*a*, 31*b* extend in a direction that is substantially transverse to the longitudinal direction of the opposing edges 21, 23 of the top wall 22. For clarity, a fold line that defines an edge and the edge are designated with the same element numeral.

In the exemplary embodiment, the top wall fold lines 31*a*, 31*b*, and hence the sides of the slot 80 itself, diverge slightly as the top wall fold lines 31*a*, 31*b* extend from the second side wall panel 24 toward the first side wall panel 20. At a first end of the handle 30 closest to the edge 23, the top wall fold lines 31*a*, 31*b* converge and intersect the slit 33. The slit 33 defines the first end of the handle 30. The opposing sides of the slit 33 may be joined by a nib member (or connecting point) 33*d*. The slit 33, and hence the first end of the handle 30, is offset from the edge 23 of the top wall panel 22 along which the second side wall panel 24 is connected.

The cut line 45, which may have an arced configuration, is disposed between the first end of the handle 30 and the fold line 23 that defines the intersection and line of joinder of the top wall panel 22 with the second side wall panel 24. The arced configuration of the interposed cut line 45 is substantially concentric with the curvilinear first end of the handle 30 formed by the curvilinear slit 33. The diverging top wall fold lines 31*a*, 31*b* intersect the fold line 21 along which the first side wall panel 20 and the top wall panel 22 are adjoined. A second end of the handle 30 is formed in the first side wall panel 20. Side wall fold lines 39*a*, 39*b* extend from points where the diverging top wall fold lines 31*a*, 31*b* intersect the fold line 21 and converge toward one another along a portion of the first side wall panel 20. Although in alternative embodiments that will be discussed below, each top wall fold line 31*a*, 31*b* is collinear with a respective side wall fold lines 39*a*, 39*b*, in the embodiment of FIGS. 1-6, the top wall fold lines 31*a*, 31*b* are disposed at an obtuse angle $\alpha$ with respect to side wall fold lines 39*a*, 39*b*. The converging side wall fold lines 39*a*, 39*b* terminate at a severance line or cut line 43. The cut line 43 may take many different configurations that serve to terminate the extension of the side wall fold lines 39*a*, 39*b*. In the exemplary embodiment of FIGS. 1-6, the cut line 43 is substantially parallel to the fold line 21 along which the first side wall panel 20 and top wall panel 22 are adjoined. The cut line 43 is also shown as having an undulating, or serpentine, configuration. To help facilitate an understanding of the arrangement of the side wall fold lines 39*a*, 39*b*, an imaginary extension of the side wall fold lines 39*a*, 39*b* from the cut line 43 to an imaginary vertex or focal point F1 is shown.

Referring further to FIG. 3, a top wall medial severance line 35 extends substantially, but not completely, across the top wall panel 22 from the slit 33 that defines the first end of the handle to the edge 21 of the top wall 22 defined by the fold line 21 at the first side wall panel 20. The top wall medial severance line 35 is disposed mediate the opposing top wall fold lines 31*a*, 31*b*. A side wall medial severance line 41, which may be considered a collinear extension of the top wall medial severance line 35, extends across a portion of the first side wall panel 20 terminating at the convergence of the converging side wall fold lines 39*a*, 39*b* or otherwise the cut line 43. Each medial severance line 35, 41 may include or be interrupted by at least one respective nib member or connecting point 35*d*, 41*d* that inhibits separation of the substrate along the medial severance line 35, 41 until the connecting points 35*d*, 41*d* are broken.

Still referring to FIG. 3, the substrate from which the blank 14 and its erected carton 12 are formed extends across the interior of what would otherwise be the slot 80 or handle opening. Although the invention teaches that a single handle flap may be employed, a pair of opposing pivotable handle flaps provides optimum flexibility of operation. Although the handle flaps may be considered to extend along the entire length of the slot 80 or handle opening, in the exemplary embodiment of FIGS. 1-6, the handle flaps 32 are described as including primary webs 34*a*, 34*b* and secondary webs 36*a*, 36*b* for convenience of explanation. Alternatively, the webs 34*a*, 34*b*, 36*a*, 36*b*, may be considered to extend from the primary handle flap portions 32*a*, 32*b*. The configurations of the webs 34*a*, 34*b*, 36*a*, 36*b* are defined in part by the fold line 21 that defines the edge between the first side wall panel 20 and the top wall panel 22 and by auxiliary fold lines 37*a*, 37*b*. The webs 34*a*, 34*b*, 36*a*, 36*b* facilitate the pivotable folding of the substrate of the handle flaps 32 at the corner of intersection of the first side wall 20 and the top wall 22 in the erected carton 12.

Figure 4:
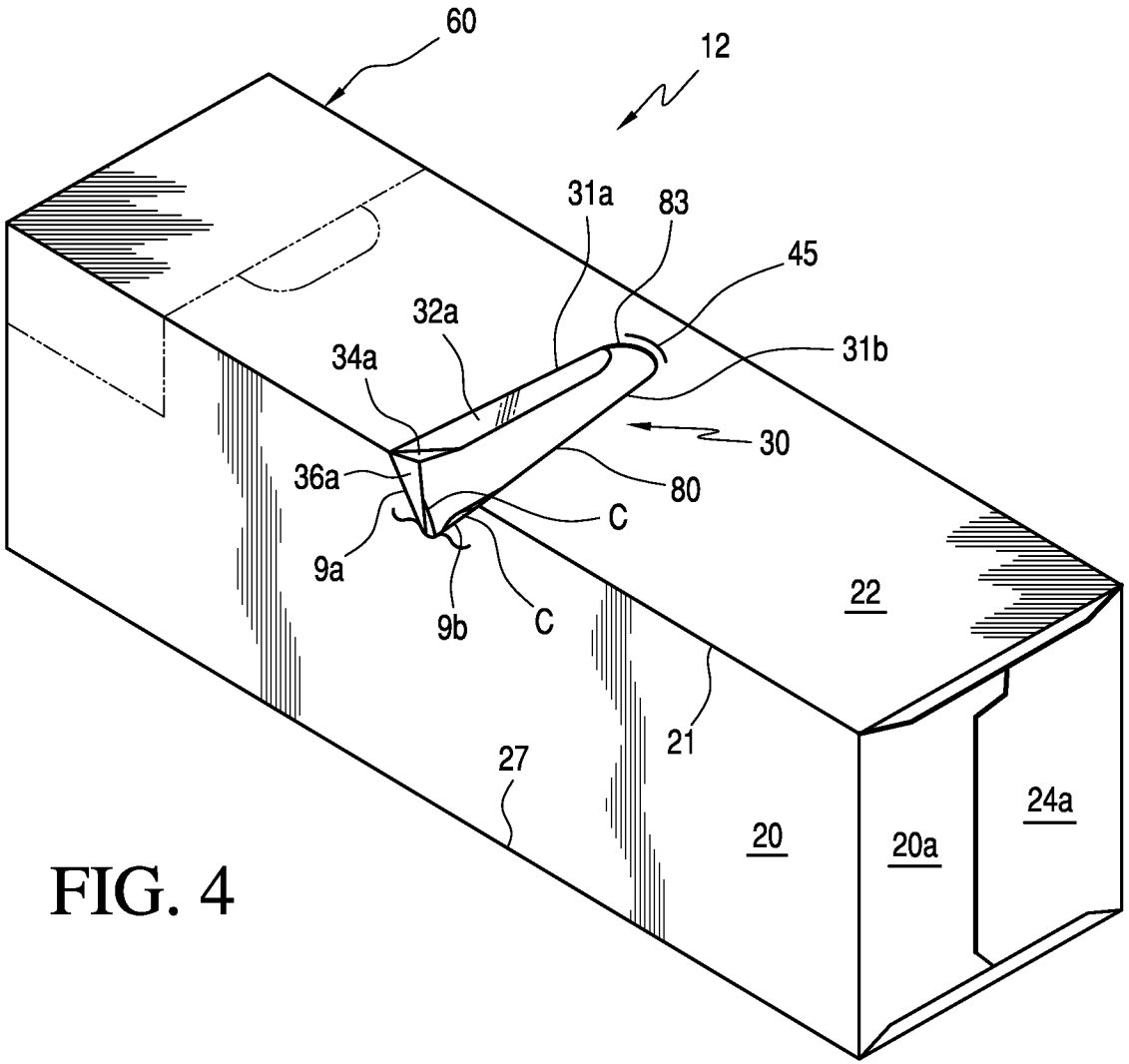
FIG. 4 is a perspective view of the carton of FIG. 1 illustrating handle flaps being folded inwardly so as to facilitate engagement of the handle.

Referring now to FIG. 4, the handle 30 is illustrated in a deployed form in an erected carton 12. One of the handle flaps 32 and its associated webs 34*a*, 36*a* are shown as being pushed and pivoted inwardly into the carton 12 interior so that the handle 30 may be grasped and engaged through insertion of an individual's hand (see FIG. 5). The handle 30 is suited for use with cartons 12 that form packages for cylindrical articles such as cans. In the illustrated embodiment, the handle 30 is disposed in the top wall 22 over a space formed by the curved walls of adjacent cans C. The space between the cans C helps facilitate insertion of the hand of an individual.

It is to be noted that in beverage cans the diameter of the tops and bottoms of cans are typically smaller than the body of the can. The top regions and bottom regions of these cans typically taper inwardly from the body of the can to the top and bottom endmost portions. Furthermore, the top of a typical beverage can have a smaller diameter than a bottom. Thus the top regions of beverage cans typically have a more pronounced taper and often a longer taper than the bottom regions. The handle 30 incorporates the can taper in its mode of operation. By offsetting the slot 80 over the taper of the cans C, greater access for grasping the handle 30 is achieved and the handle flaps 32 are more easily pivoted inwardly to access the slot 80. Further still, in a package wherein the slot 80 is offset over the top regions of beverage cans, even more space for engaging the handle 30 and pivoting the handle flaps 32 inwardly is obtained.

Referring still to FIG. 4, although one embodiment has been described substantially thus far as a handle 30 with handle flaps 32, an alternative embodiment of a handle 30 includes a slot 80 that is formed without handle flaps or includes handle flaps that have been pivoted or otherwise pushed out of the planes of the top wall 22 and first side wall 20. The slot 80 has opposing sides, each side comprising a top wall edge defined by fold lines 31*a*, 31*b* and a side wall edge defined by fold lines 39*a*, 39*b*. The top wall edges 31*a*, 31*b* and side wall edges 39*a*, 39*b* are defined in the top wall 22 and first side wall 20, respectively, as the primary handle flap portions 32*a*, 32*b* are folded along the top wall fold lines 31*a*, 31*b* and side wall fold lines 39*a*, 39*b*. A first end 83 of the slot 80 that is offset from the edge 23 of the top wall 22 is defined by the slit 33.

Figure 5:
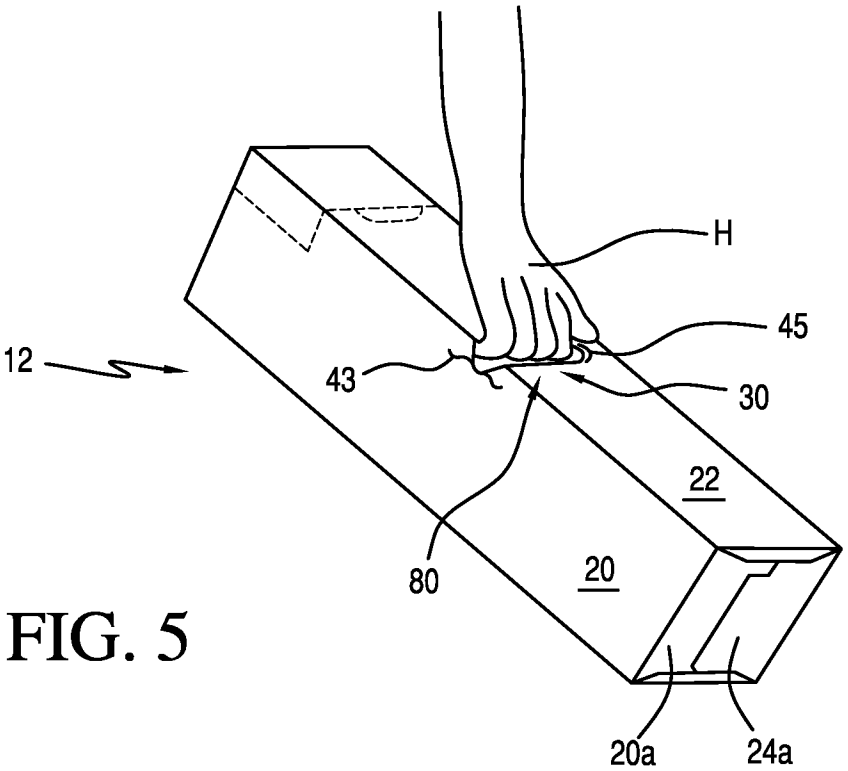
FIG. 5 is a perspective view of the carton of FIG. 1 illustrating the carrying handle being engaged by a hand.

FIG. 5 shows the handle 30 engaged by the hand H of an individual. The handle 30 is offset toward the first side wall 20 of the carton 12. The offset placement of the handle 30 causes the loaded carton 12 to tilt toward the side wall (the first side wall 20) into which the handle 30 extends thereby optimally distributing stress from the weight of the loaded carton 12.

Figure 6:
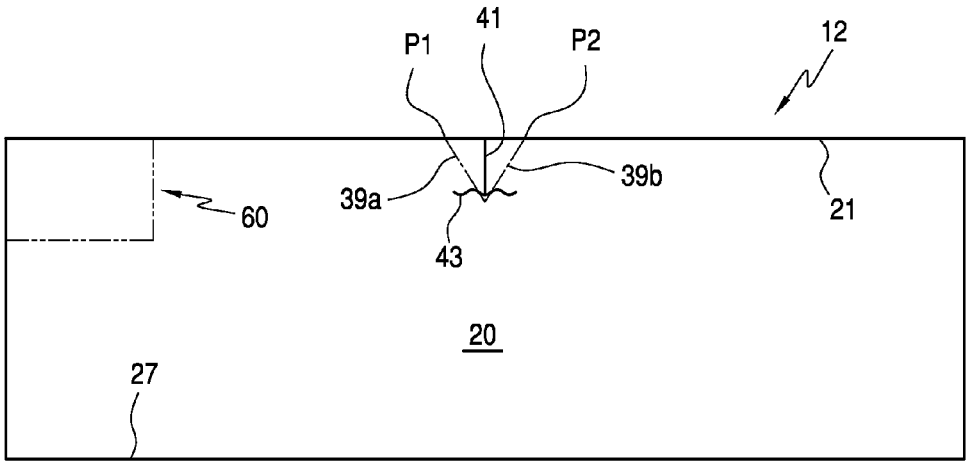
FIG. 6 is a side elevation view of the carton of FIG. 1.

Referring now to FIG. 6, some of the features previously discussed are shown in slightly greater detail, or at least from a different vantage point. The side wall fold lines 39*a*, 39*b* are aligned such that that they extend from points of intersection P1, P2 along the edge or fold line 21 to the cut line 43. To facilitate an understanding of the arrangement of the side wall fold lines 39*a*, 39*b*, an imaginary extension of the side wall fold lines 39*a*, 39*b* from the cut line 43 to an imaginary vertex or focal point F1 is shown.

Figure 7:
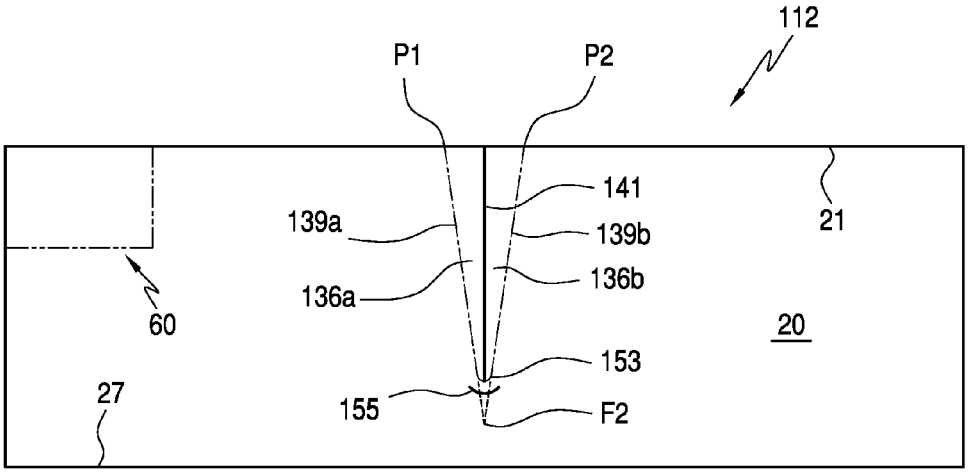
FIG. 7 is a side elevation view of a carton that includes a handle and an alternative side wall component, according to a second exemplary embodiment.

Referring now to FIG. 7, in a second exemplary embodiment, side wall fold lines 139*a*, 139*b* extend from points of intersection P1, P2 along the edge or fold line 21 to a severance line or cut line 153. The cut line 153 may be curved as shown. To facilitate an understanding of the arrangement of the side wall fold lines 139*a*, 139*b*, an imaginary extension of the side wall fold lines 139*a*, 139*b* from the cut line 153 to an imaginary vertex or focal point F2 is shown. A side wall medial severance line 141 bisects the side wall fold lines 139*a*, 139*b* to form opposing webs 136*a*, 136*b*. A severance line or cut line 155, which may have an arced or partially concave configuration, is offset from the termination points of the side wall fold lines 139*a*, 139*b* at the cut line 153. The cut line 155, is disposed between a second end or side wall portion of the handle 30 and the side wall edge formed by the fold line 27 that defines the intersection of the first side wall 20 and the bottom wall 26 (not seen in this view) by way of the auxiliary panel 28 (not seen in this view). The arced configuration of the cut line 155 is substantially concentric with the curvilinear second end of the slot 80 formed by cut line 153.

Figure 8:
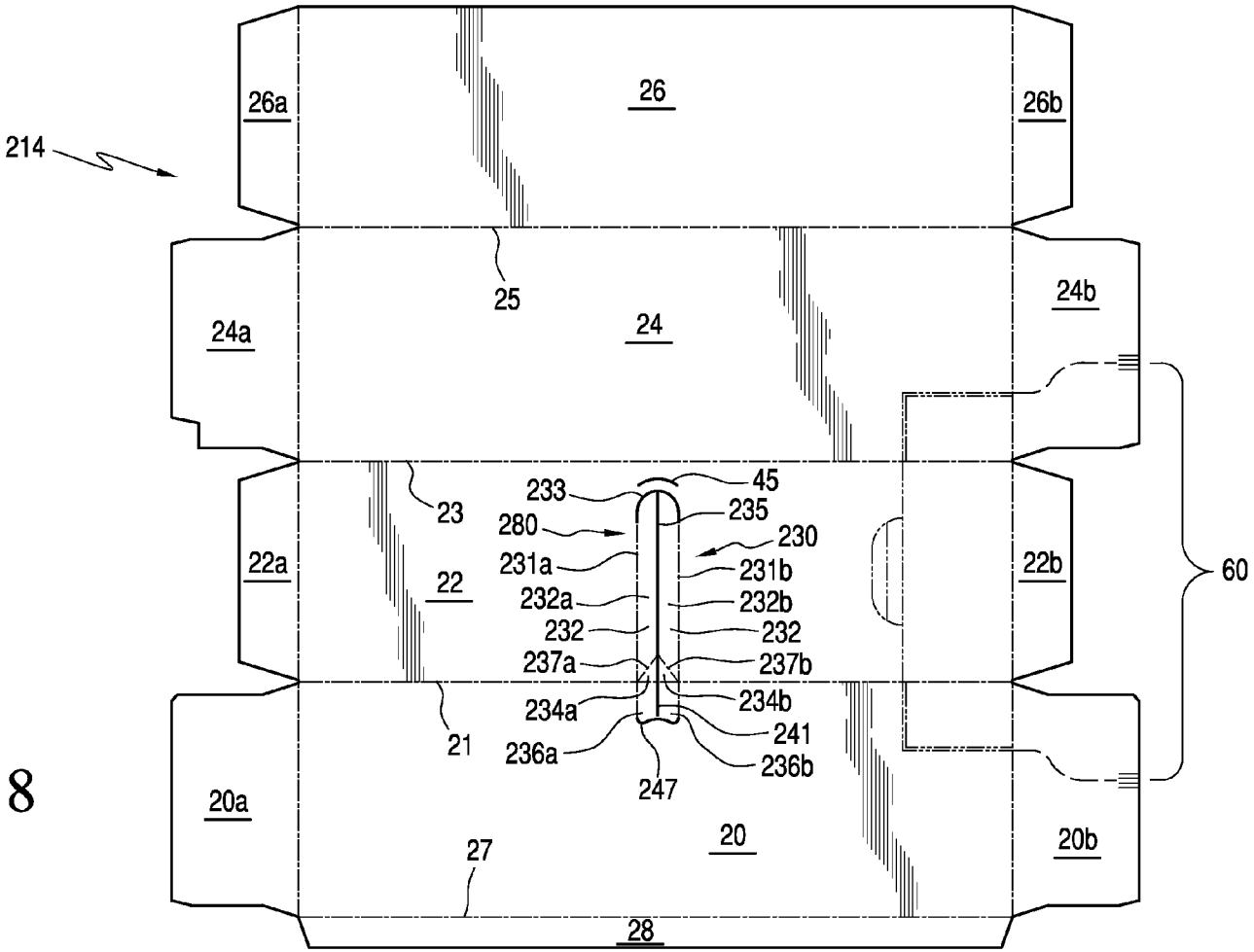
FIG. 8 is a plan view of a blank suitable for forming a carton, according to a third exemplary embodiment.

Referring now to FIG. 8, therein is shown in a top plan view of a third exemplary embodiment in which a blank 214 for forming a carton has an alternative carrying handle 230. Although the handle 30 taught by the first embodiment has been previously described herein as including engaging edges 31*a*, 31*b* that diverge as they approach the fold line 21, the third embodiment teaches a handle 230 having parallel top wall fold lines 231*a*, 231*b* or engaging edges. The third exemplary embodiment of FIG. 8 will be described using numerals in a "200" series to identify features. For convenience of explanation, features that are similarly disposed or positioned as features in the exemplary embodiment of FIGS. 1-6 will be enumerated in the "200" series but with the same ending numerals as the FIG. 1-6 counterpart. In FIG. 8, environmental features of the blank and carton that are the same as those of the embodiment shown in FIGS. 1-6 bear the identical numerals assigned to those features in FIGS. 1-6.

The handle 230 is shown as integrally formed in portions of the top wall panel 22 and first side wall panel 20. The slot 280 that serves as the handle 230 is a handle opening that is formed in the top wall panel 22 and first side wall panel 20. The slot 280 may be initially occupied and subsequently vacated by a pair of pivotable primary handle flaps 232 including primary handle flap portions 232*a*, 232*b* of the handle flaps and webs associated therewith. Handle engaging edges of the slot 280, and, in turn, the primary handle flap portions 232*a*, 232*b*, are formed in part by top wall fold lines 231*a*, 231*b*. The top wall fold lines 231*a*, 231*b* are a pair of opposing weakened lines that extend substantially, but not entirely, across the width of the top wall panel 22. The top wall fold lines 231*a*, 231*b* extend in a direction that is substantially transverse to the direction of the opposing edges 21, 23 of the top wall panel 22.

In the third exemplary embodiment, the top wall fold lines 231*a*, 231*b*, and hence the sides or handle engaging edges of the slot 280 itself are substantially parallel and extend from a point offset from the second side wall panel 24 to the first side wall panel 20. At the first end of the handle 230 that is proximate and offset from the edge 23 of the top wall panel 22 (edge 23 lies between the top wall 22 and the second side wall 24), top wall fold lines 231*a*, 231*b*, intersect a severance line or curvilinear slit 233 that defines the first end of the handle 230. The slit 233 include a nib member (or connecting point) as previously described with respect to the slit 33 of the embodiment of FIGS. 1-6. The slit 233, and hence the first end of the handle 230, is offset from the edge 23 of the top wall 22 along which the second side wall 24 is connected. The cut line 45 has an arced configuration and is disposed between the first end of the handle 230 and the fold line 23. The arced configuration of the interposed cut line is substantially concentric with the curvilinear first end of the handle 230 formed by the curvilinear slit 233. At the opposing end of the top wall portion of the handle, the top wall fold lines 231*a*, 231*b* intersect the edge or fold line 21. Side wall fold lines 239*a*, 239*b* extend from the fold line 21 across a portion of the first side wall 20 and are substantially collinear with the top wall fold lines 231*a*, 231*b*. The side wall fold lines 239*a*, 239*b* terminate at a cut line 247. The cut line 247 may take many different configurations that serve to terminate the extension of the side wall fold lines 239*a*, 239*b*. In the third embodiment illustrated, the cut line 247 is substantially parallel to the fold line 21 along which the first side wall 20 and top wall 22 are adjoined. As shown, the cut line 247 has a substantially shallow, U-shaped configuration.

Continuing with FIG. 8, a top wall medial severance line 235 extends substantially, but not completely, across the top wall panel 22 from the curved slit 233 that defines the first end of the handle 230 to the edge of the top wall 22 defined by the fold line 21 at the first side wall 20. The top wall medial severance line 235 is disposed mediate the opposing top wall fold lines 231*a*, 231*b*. A side wall medial severance line 241, which may be considered a collinear extension of the top wall medial severance line 235, extends from the fold line 21 across a portion of the first side wall 20 terminating at the cut line 247. Each medial severance line 235, 241 may be interrupted by at least one respective nib member (or connecting point), shown but not numbered, that inhibits separation of the substrate along the medial severance line 235, 241 until the connecting points are broken.

Still referring to FIG. 8, the substrate from which the blank 214 and its erected carton are formed extends across the interior of what would otherwise be the slot 280 or handle opening. Although a single handle flap may be employed, a pair of opposing pivotable handle flaps provides optimum flexibility of operation. Although the handle flaps may be considered to extend along the entire length of the slot 280 or handle opening, in the third embodiment, the handle 230 includes handle flaps 232 with top wall portion and side wall portions that are configured to fold inwardly. For convenience of explanation, the handle flap portions are designated primary handle flaps (portions connected along fold lines 231*a*, 231*b*), primary webs 234*a*, 234*b* and secondary webs 236*a*, 236*b*. Alternatively, the webs 234*a*, 234*b*, 236*a*, 236*b*, may be considered to extend from the primary handle flap portions 232*a*, 232*b*. The configurations of the webs 234*a*, 234*b*, 236*a*, 236*b* are defined in part by the fold line 21 that defines the edge between the first side wall 20 and the top wall 22 and auxiliary fold lines 237*a*, 237*b*. The webs 234*a*, 234*b*, 236*a*, 236*b* facilitate the pivotable folding of the handle flap substrate at the corner of intersection of the first side wall 20 and the top wall 22 in an erected carton. Alternatively described, the webs facilitate folding the top wall portion of a handle flap relative to the side wall portion of a handle flap since the handle flap is connected to the handle opening along a non-linear fold line.

Figure 9:
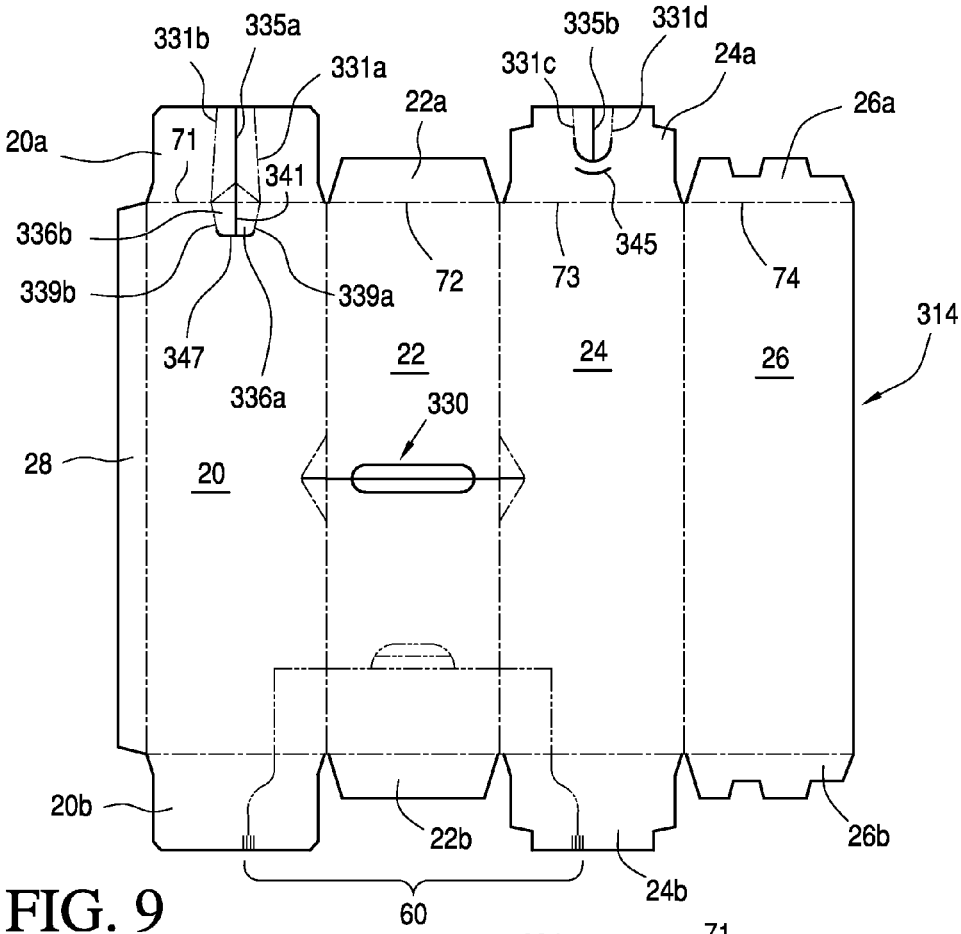
FIG. 9 is a plan view of a blank suitable for forming a carton, according to a fourth exemplary embodiment.
Figure 10:
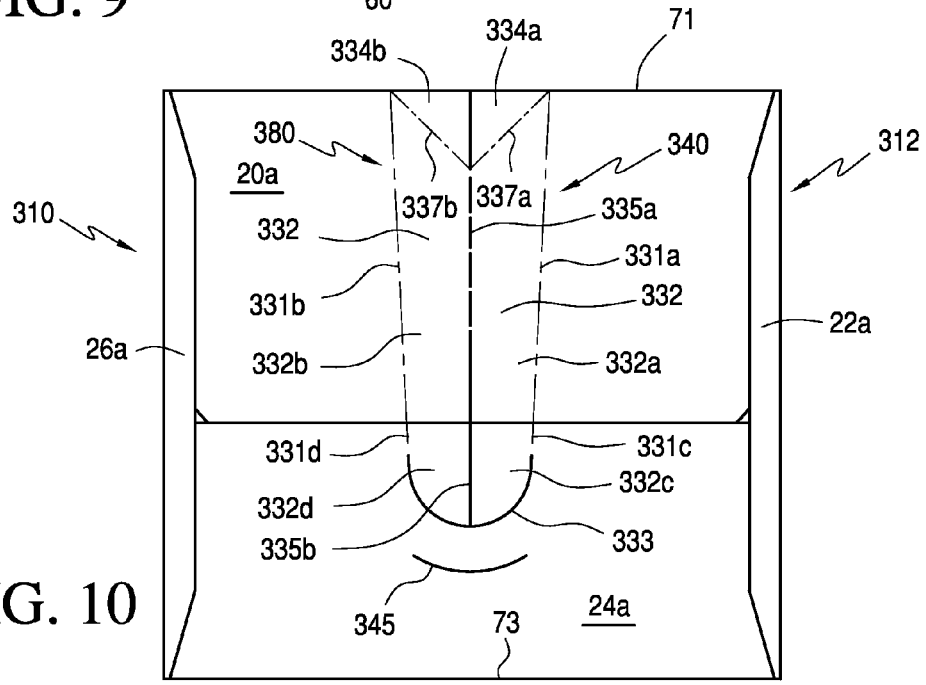
FIG. 10 is an end elevation view of a carton formed from the blank of FIG. 9.

FIGS. 9 and 10 illustrate a fourth exemplary embodiment. The fourth embodiment will be described using reference numerals in a "300" series to identify features. For convenience of explanation, features that are similarly disposed or positioned as features in the exemplary embodiment of FIGS. 1-6 will be enumerated in the "300" series but with the same ending numerals as the FIGS. 1-6 counterpart. In FIGS. 9 and 10, environmental features of a blank 314 and a carton 312 that are the same as those of the embodiment shown in FIGS. 1-6 bear the identical numerals assigned to those features in FIGS. 1-6.

The carton 312 of the fourth embodiment has two different alternative handles 330, 340. The carrying handle 330 in the top wall 22 and side walls 20, 24 is well known in the art and is disclosed in U.S. Pat. No. 4,558,816 which is hereby incorporated by reference. The carrying handle 340 is provided in the first side wall as well as in a handled end wall 310 shown in FIG. 10 that is located opposite to the end where the dispenser 60 is provided. The handled end wall 310 is formed from a pair of side end flaps 20*a*, 24*a* and a pair of top and bottom end flaps 22*a*, 26*a*. To form the handled end wall 310, the top and bottom end flaps 22*a*, 26*a* are folded inwardly about the fold lines 72, 74, and then the side end flaps 20*a*, 24*a* are folded inwardly about the fold lines 71, 73 to lie over the top and bottom end flaps 22*a*, 26*a*. In the formed handled end wall 310, the side end flaps 20*a*, 24*a* are disposed in an overlapping relationship and secured together as shown in FIG. 10. The securing of the side end flaps 20*a*, 24*a* can be achieved by one or more strips of glue applied along the free edge of either the outer or inner of the side end flaps 20*a*, 24*a*. The side end flaps 20*a*, 24*a* may also be secured by glue to the outside surfaces of the top and bottom end flaps 22*a*, 26*a*.

The general structure of the carrying handle 340 is similar in one way to the handle 30 of FIGS. 1-6 and in another way to the handle 230 of FIG. 8. The handle 340 is shown as integrally formed in portions of the handled end wall 310 and first side wall 20. The carrying handle 340 includes a slot 380 or handle opening that is formed in the handled end wall 310 and the first side wall 20. The slot 380 may be initially occupied and subsequently vacated by two pairs of pivotable handle flaps 332 including primary handle flap portions 332*a*, 332*b*, 332*c*, 332*d* and webs 334*a*, 334*b*, 336*a*, 336*b* associated therewith. Major primary handle flap portions 332*a*, 332*b* are defined by a pair of fold lines 331*a*, 331*b* that extend entirely across the length of the outer side end flap 20*a* and by a medial severance line 335*a* which may be a perforated slit or cut line that also extends entirely across the length of the side end flap 20*a*. Minor primary handle flap portions 332*c*, 332*d* are defined by a pair of fold lines 331*c*, 331*d* that do not extend entirely across the length of the side end flap 24*a* but are aligned with the fold lines 331*a*, 331*b* respectively. The aligned fold lines 331*a*, 331*c* define one of the opposed side edges or engaging edges of the slot 380 whereas the other aligned fold lines 331*b*, 331*d* define the other of the side edges or engaging edges of the slot 380. The side edges 331*a*/331*c*, 331*b*/331*d* of the slot 380 diverge slightly as they extend from a location offset from the second side wall 24 (or the fold line 73) toward the first side wall 20 (or the fold line 71).

At a first end of the side edges 331*a*/331*c*, 331*b*/331*d*, the side edges 331*a*/331*c*, 331*b*/331*d* intersect a severance line or curvilinear slit 333 that defines the first end of the slot 380 and handle 340. The slit 333 is formed within the side end flap 24*a*. The slit 333 may include a nib member. The slit 333, and hence the end of the handle 340, is offset from the edge 73 of the handled end wall 310 along which the second side wall 24 is hingedly connected. A cut line 345 that has an arced configuration is disposed between the slit 333 and the fold line 73. The arced configuration of the cut line 345 is substantially concentric with the slit 333.

The diverging fold lines 331*a*, 331*b* intersect the fold line 71 along which the first side wall 20 and the handled end wall 310 are hingedly connected. A pair of opposing, slightly converging side wall fold lines 339*a*, 339*b* extends from the ends of the diverging fold lines 331*a*, 331*b* that intersect the fold line 71 across a portion of the first side wall 20. In a similar way as in the first embodiment, the end wall fold lines 331*a*, 331*b* are disposed at an obtuse angle with respective side wall fold lines 339*a*, 339*b*. The converging side wall fold lines 339*a*, 339*b* terminate at a cut line 347. The cut line 347 can take many different configurations that serve to terminate the extension of the side wall fold lines 339*a*, 339*b*. In the fourth embodiment illustrated, the cut line 347 is substantially parallel to the fold line 71. The illustrated cut line 347 includes a substantially shallow, U-shaped, or slightly arched, configuration.

Referring to FIG. 10, the end wall medial severance line 335*a*/335*b* extends substantially, but not completely, across the handled end wall 310 from the slit 333 that defines the first end of the handle 340 to the edge 71 of the handled end wall 310. The medial severance line segment 335*a* is formed in the side end flap 20*a* and is disposed mediate the opposing end wall fold lines 331*a*, 331*b*. The other medial severance line segment 335*b* is formed in the side end flap 24*a* and is disposed mediate the opposing end wall fold lines 331*c*, 331*d*. A side wall medial severance line 341, which may be considered a collinear extension of the end wall medial severance line 335*a*/335*b*, extends across a portion of the first side wall 20 terminating at the cut line 347. The medial severance line 335*a*/335*b*, 341 may, or may not, be interrupted by at least one respective nib member (or connecting point), shown but not numbered, that inhibits separation of the substrate along the medial severance line 335*a*/335*b*, 341 until the connecting points are broken.

Still referring to FIG. 10, the glue seam between the inner and outer of the side end flaps 24*a*, 20*a* may be created such that upon inward displacement of the handle flaps (to use the handle 340), the primary handle flap portions 332*a*, 332*c* remain secured together as do the primary handle flap portions 332*b*, 332*d*.

Although the handle flaps 332 may be considered to extend along the entire length of the slot 380, in the fourth embodiment, the handle flaps 332 are each configured to fold an end wall portion thereof with respect to a side wall portion thereof to facilitate folding the handle flap 332. For convenience of explanation, portions of the handle flaps are designated primary handle flap portions 332*a*, 332*b*, 332*c*, 332*d* primary webs 334*a*, 334*b* and secondary webs 336*a*, 336*b*. Alternatively, the webs 334*a*, 334*b*, 336*a*, 336*b*, may be considered to extend from the primary handle flap portions 332*a*, 332*b*, 332*c*, 332*d*. The configurations of the webs 334*a*, 334*b*, 336*a*, 336*b* are defined in part by the fold line 71 and auxiliary fold lines 337*a*, 337*b*. The webs 334*a*, 334*b*, 336*a*, 336*b* facilitate the pivotable folding of the handle flaps 332 at the corner of the intersection of the first side wall 20 and the handled end wall 310 in the erected carton 312.

Figure 11:
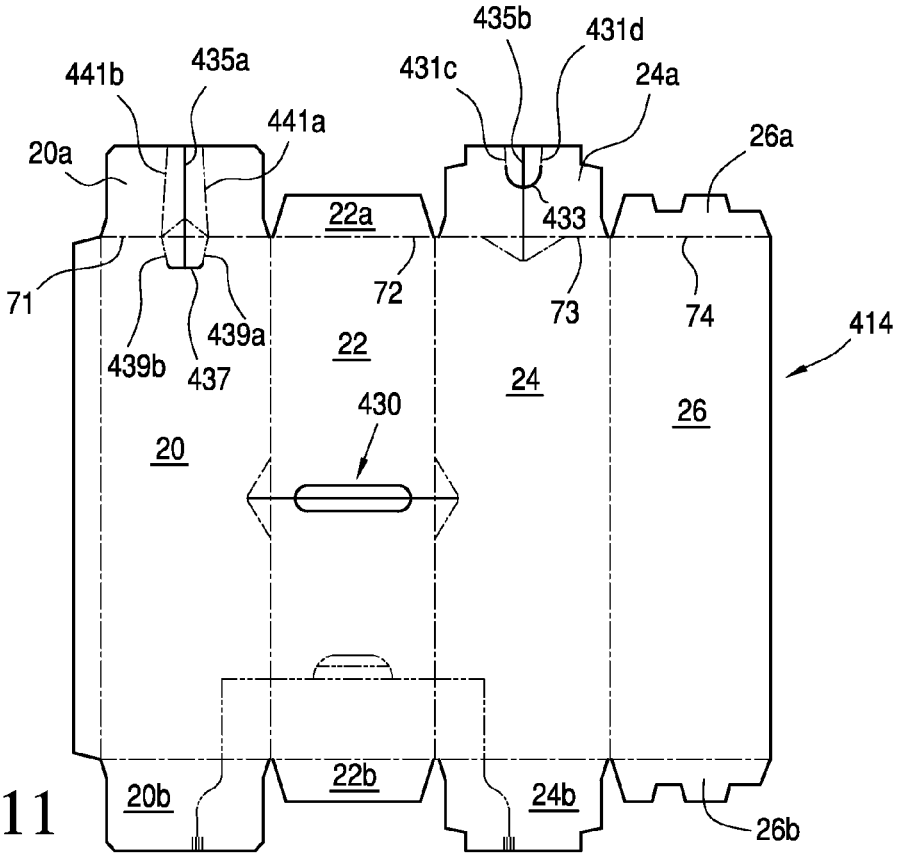
FIG. 11 is a plan view of a blank suitable for forming a carton, according to a fifth exemplary embodiment.
Figure 12:
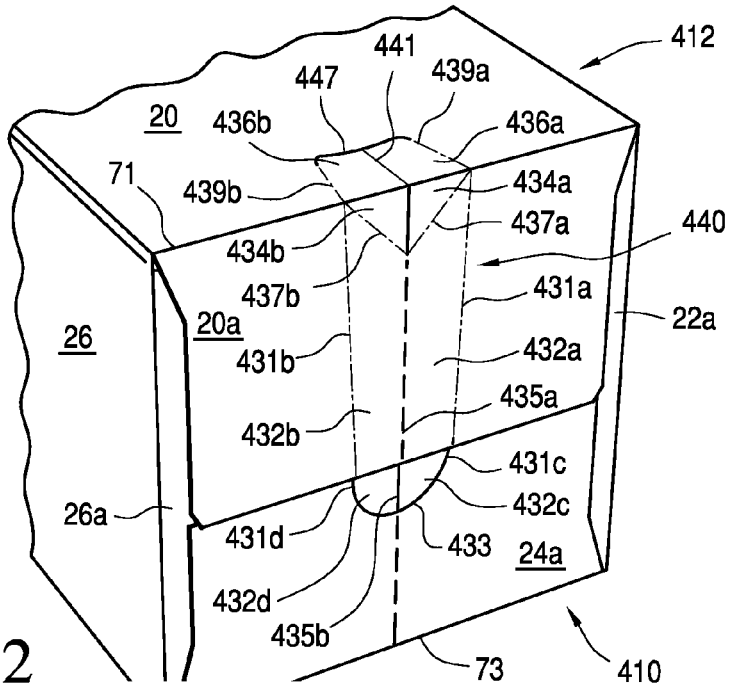
FIGS. 12 and 13 are fragmentary perspective views of opposed ends of a carton formed from the blank of FIG. 11.
Figure 13:
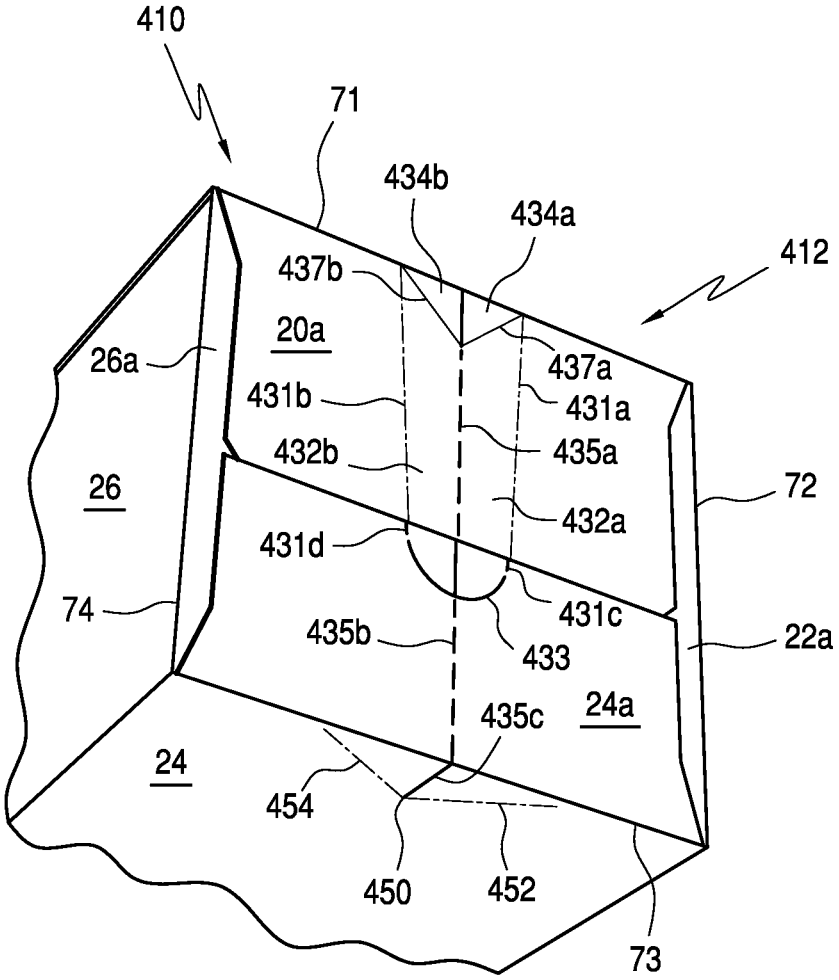

FIGS. 11 to 13 illustrate a fifth exemplary embodiment. The fifth embodiment will be described using reference numerals in a "400" series to identify features. For convenience of explanation, features that are similarly disposed or positioned as features in the exemplary embodiment of FIGS. 9 and 10 will be enumerated in the "400" series but with the same ending numerals as the FIGS. 9 and 10 counterpart. In FIGS. 11 to 13, environmental features of a blank 414 and a carton 412 that are the same as those of the embodiment shown in FIGS. 1-6 bear the identical numerals assigned to those features in FIGS. 1-6.

The carton 412 of the fifth embodiment also has two different carrying handles 430 and 440. The carrying handle 430 in the top wall 22 and side walls 20, 24 is identical to the carrying handle 330 shown in FIG. 9. The carrying handle 440 in the handled end wall and the first side wall 20 is similar to the carrying handle 340 shown in FIGS. 9 and 10. The difference between the carrying handles 340 and 440 resides in the stress relief component that is located in the side end flap 24*a* and the second side wall panel 24. Therefore, only the different stress relief handle component of the carton 412 of the fifth embodiment will be described herein below.

The carrying handle 440 of the carton 412 does not have an arched cut line adjacent to the curvilinear slit 433 that defines the first or offset end of the carrying handle 440. Instead, the end wall medial severance line 435*a*/435*b* extends substantially completely across the handled end wall 410 between the fold lines 71, 73. Referring to FIG. 12, the medial severance line segment 435*b* is extended all the way across the length of the side end flap 24*a*. The severance line segment 435*b* is further extended into the second side wall 24 to form an end projection 435*c* that is disposed substantially perpendicularly to the handled end wall 410 or the side end flap 24*a*, which is best shown in FIG. 13. The length of the end projection 435*c* may be approximately twice the distance between the medial severance line segment 435*a* and one of the fold lines 431*a*, 431*b*. At the terminal end of end projection 435*c*, an arched terminal severance line or cut 450 is provided to reduce the chance of a tear developing from the terminal end of the end projection 435*c*. A pair of fold lines 452, 454 are formed in the second side wall 24 and extend from the terminal cut 450 divergently to the fold line 73.

Figure 14:
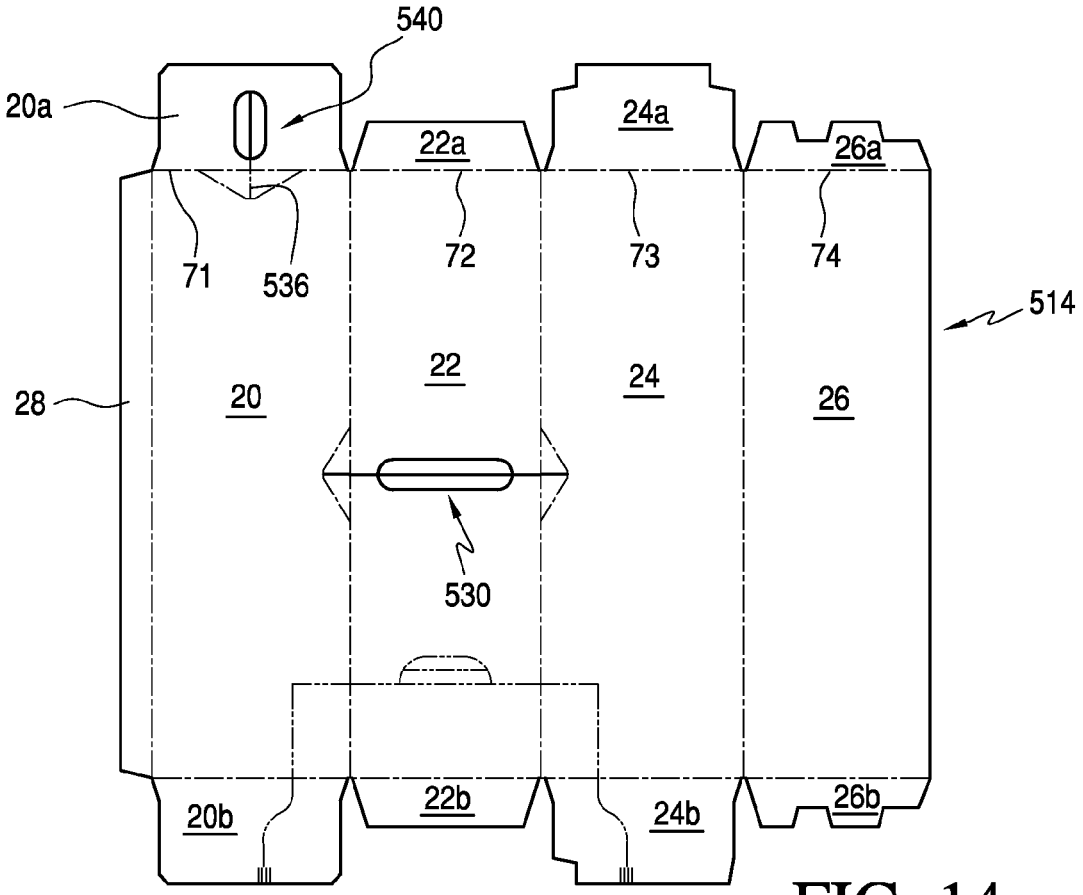
FIG. 14 is a plan view of a blank suitable for forming a carton, according to a sixth exemplary embodiment.
Figure 15:
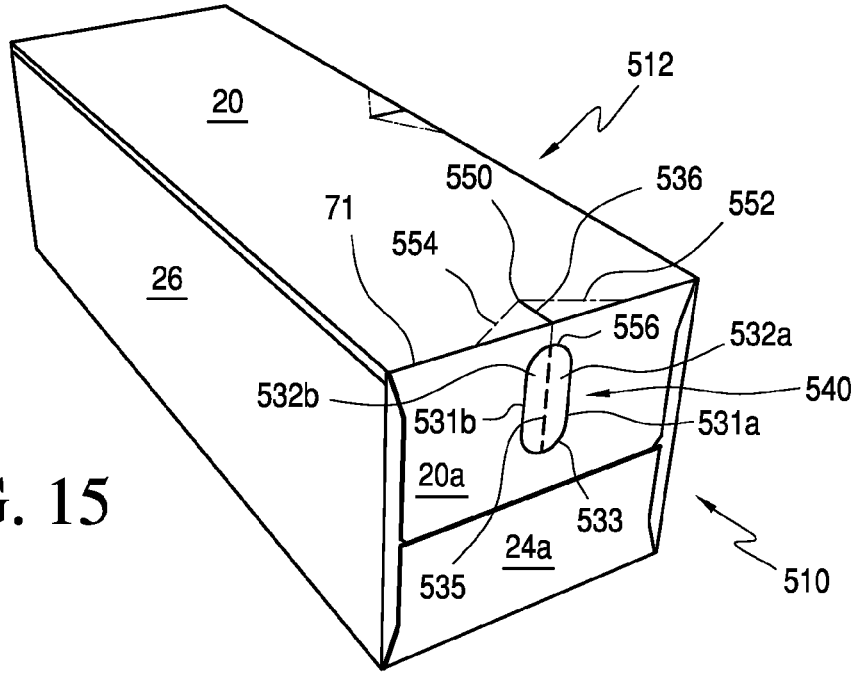
FIG. 15 is a perspective view of a carton formed from the blank of FIG. 14.

FIGS. 14 and 15 illustrate a sixth exemplary embodiment of the invention. The sixth embodiment will be described using reference numerals in a "500" series to identify features. For convenience of explanation, features that are similarly disposed or positioned as features in the exemplary embodiment of FIGS. 9 and 10 will be enumerated in the "500" series but with the same ending numerals as the FIGS. 9 and 10 counterpart. In FIGS. 14 and 15, environmental features of a blank 514 and a carton 512 that are the same as those of the embodiment shown in FIGS. 1-6 bear the identical numerals assigned to those features in FIGS. 1-6.

The carton 512 of the sixth embodiment also has two different carrying handles 530 and 540. The carrying handle 530 in the top wall 22 and side walls 20, 24 is identical to the carrying handle 330 shown in FIG. 9. The carrying handle 540 in the handled end wall 510 and the first side wall 20 differs from the carrying handle 340 in that the carrying handle 540 is formed only in the outer side end flap 20*a* and the first side wall 20.

The carrying handle 540 of the carton 512 is defined by a pair of substantially parallel weakened lines (e.g., fold lines) 531*a*, 531*b* formed in the side end flap 20*a* and a pair of arched severance or cut lines 533, 556 formed also in the side end flap 20*a*. Each arched cut line 533, 556 extends between the adjacent ends of the fold lines 531*a*, 531*b* to surround a substantially elliptical area provided solely by the side end flap 20*a*. The elliptical area represents the edge of a handle opening or slot 580. A medial severance line 535 extends from the cut line 533 all the way to the other cut line 556 and further extends to the fold line 71. As a result, a pair of handle flaps 532*a*, 532*b* is struck from the elliptical area. Stated differently, the medial severance line 535 defines a common free side edge of each of the handle flaps 532*a*, 532*b*. The handle flaps 532*a*, 532*b* are inwardly foldable about their respective fold lines 531*a*, 531*b* to provide the open slot 580 in the side end flap 20*a*. In this embodiment, the other side end flap 24*a* remains intact upon formation of the slot 580.

The medial severance line 535 extends further into the first side wall 20 to form an end projection 536 that is disposed substantially perpendicularly to the handled end wall 510 or the side end flap 20*a*. The length of the end projection 536 may be approximately twice the distance between the medial severance line 535 and one of the fold lines 531*a*, 531*b*. At the terminal end of end projection 536, an arched terminal cut 550 is provided to reduce the chance of a tear developing from the terminal end of the end projection 536. A pair of fold lines 552, 554 are formed in the first side wall 20 and extend from the terminal cut 550 divergently to the fold line 71.

Figure 16:
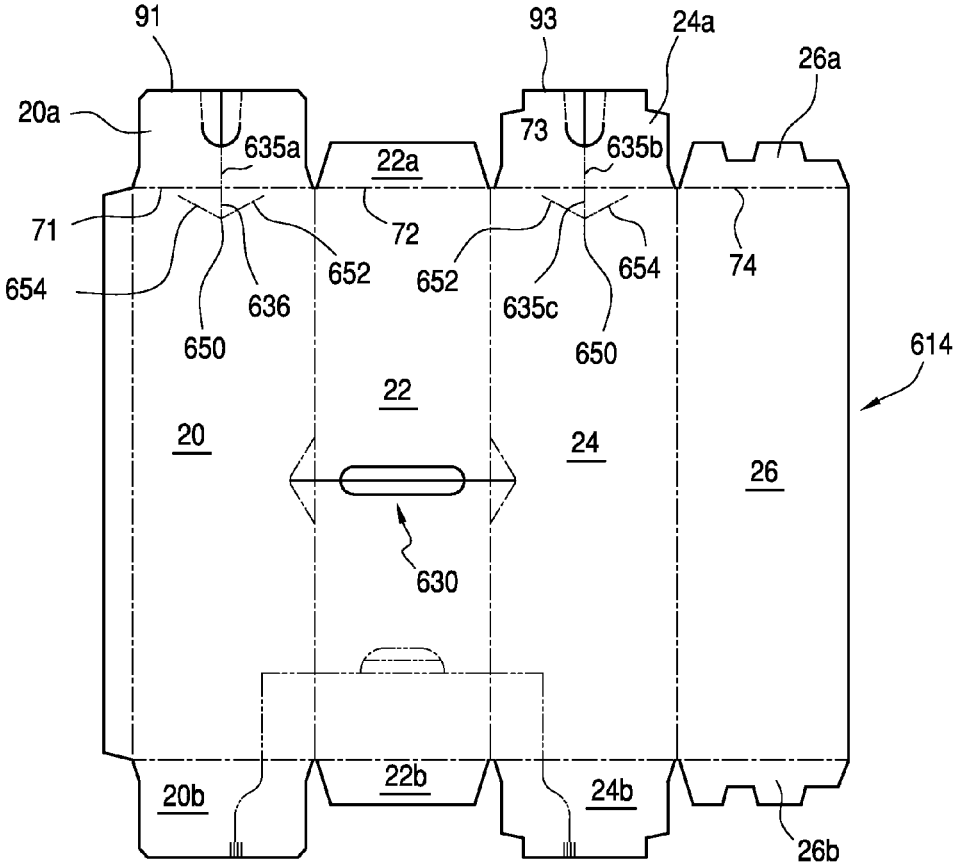
FIG. 16 is a plan view of a blank suitable for forming a carton, according to a seventh exemplary embodiment.
Figure 17:
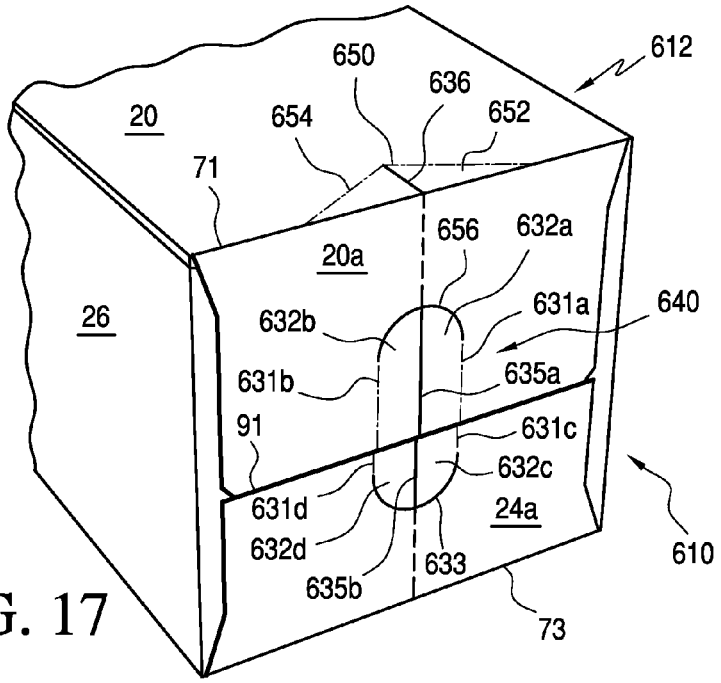
FIG. 17 is a fragmentary perspective view of an end of a carton formed from the blank of FIG. 16.

FIGS. 16 and 17 illustrate a seventh exemplary embodiment of the invention. The seventh embodiment will be described using reference numerals in a "600" series to identify features. For convenience of explanation, features that are similarly disposed or positioned as features in the exemplary embodiments of FIGS. 11 to 15 will be enumerated in the "600" series but with the same ending numerals as the FIGS. 11 to 15 counterparts. In FIGS. 16 and 17, environmental features of a blank 614 and a carton 612 that are the same as those of the embodiment shown in FIGS. 1-6 bear the identical numerals assigned to those features in FIGS. 1-6.

The carton of the seventh embodiment also has two different carrying handles 630 and 640. The carrying handle 630 in the top wall 22 and side walls 20, 24 is identical to the carrying handle 430, 530 in FIG. 11 or 14. The carrying handle 640 in the handled end wall and the side walls 20, 24 differs from the carrying handle 540 in that the carrying handles 640 is formed in the inner and outer side end flaps 24*a*, 20*a* and the side walls 24, 20.

The carrying handle 640 of the carton 612 is defined by a pair of substantially parallel weakened lines (e.g., fold lines) 631*a*, 631*b* formed in the outer side end flap 20*a* and a pair of substantially parallel weakened lines (e.g., fold lines) 631*c*, 631*d* formed in the inner side end flap 24*a*. The fold lines 631*a*, 631*c* are collinear with each other to define a single engaging edge or side edge of a handle opening or slot 680 while the other fold lines 631*b*, 631*d* are collinear with each other to define the other opposed engaging edge or side edge of the slot 680. A pair of arced cut lines 633, 656 is formed in inner and outer of the side end flaps 24*a*, 20*a* respectively. Each arced cut line 633,656 extends between the adjacent ends of the fold lines 631*a*, 631*b*, 631*c*, 631*d* to surround a substantially elliptical area provided by the inner and outer side end flaps 24*a*, 20*a*. A medial severance line segment 635*a* extends from the free edge 91 of the outer side end flap 20*a* all the way to the fold line 71. As a result, a pair of handle flap portions 632*a*, 632*b* is struck from the elliptical area. The other medial severance line segment 635*b* extends from the free edge 93 of the inner side end flap 24*a* all the way to the fold line 73. As a result, another pair of handle flap portions 632*c*, 632*d* is struck also from the elliptical area. Stated differently, the medial severance line segment 635*a* defines a common free side edge of the handle flap portions 632*a*, 632*b* that are inwardly foldable about their respective fold lines

631*a*, 631*b* whereas the medial severance line segment 635*b* defines a common free side edge of the handle flap portions 632*c*, 632*d* that are inwardly foldable about their respective fold lines 631*c*, 631*d*. The handle flap portions 632*a*, 632*c* are secured together and form a single composite hand flap 632*a*/632*c* that is inwardly foldable while the handle flaps 632*b*, 632*d* are secured together and form another single composite hand flap 632*b*/632*d* that is inwardly foldable. These two composite handle flaps 632*a*/632*c*, 632*b*/632*d* are yieldable to a user's hand to provide a slot 680 in the handled end wall 610.

The medial severance line 635*a* extends further into the first side wall 20 to form an end projection 636 that is disposed substantially perpendicularly to the handled end wall 610 or the side end flap 20*a*. The length of the end projection 636 may be approximately twice the distance between the medial severance line segment 635*a* and one of the fold lines 631*a*, 631*b*. At the terminal end of end projection 636, an arched terminal cut 650 is provided to reduce the chance of a tear developing from the terminal end of the end projection 636. A pair of fold lines 652, 654 are formed in the first side wall 20 and extend from the terminal cut 650 divergently to the fold line 71. The other medial severance line 635*b* extends further into the second side wall 24 to form an end projection 635*c* that is disposed substantially perpendicularly to the handled end wall 610 or the side end flap 24*a*. The length of the end projection 635*c* may be approximately twice the distance between the medial severance line segment 635*b* and one of the fold lines 631*c*, 631*d*. At the terminal end of end projection 635*c*, another arched terminal cut 650 is provided to reduce the chance of a tear developing from the terminal end of the end projection 635*c*. Another pair of fold lines 652, 654 are formed in the second side wall 24 and extend from the terminal cut 650 divergently to the fold line 73.

Figure 18:
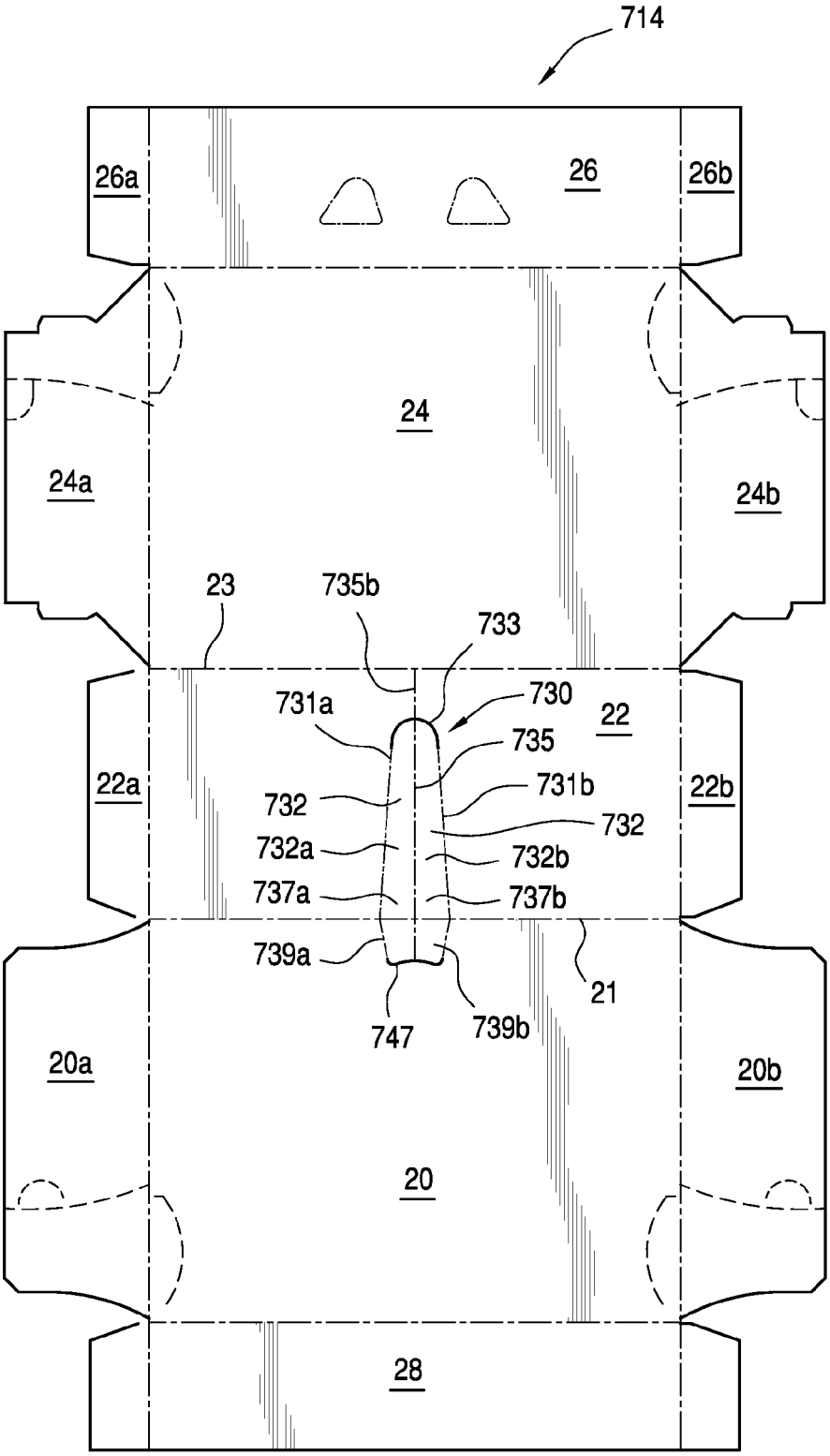
FIG. 18 is a plan view of a blank suitable for forming a carton, according to an eighth exemplary embodiment.
Figure 19:
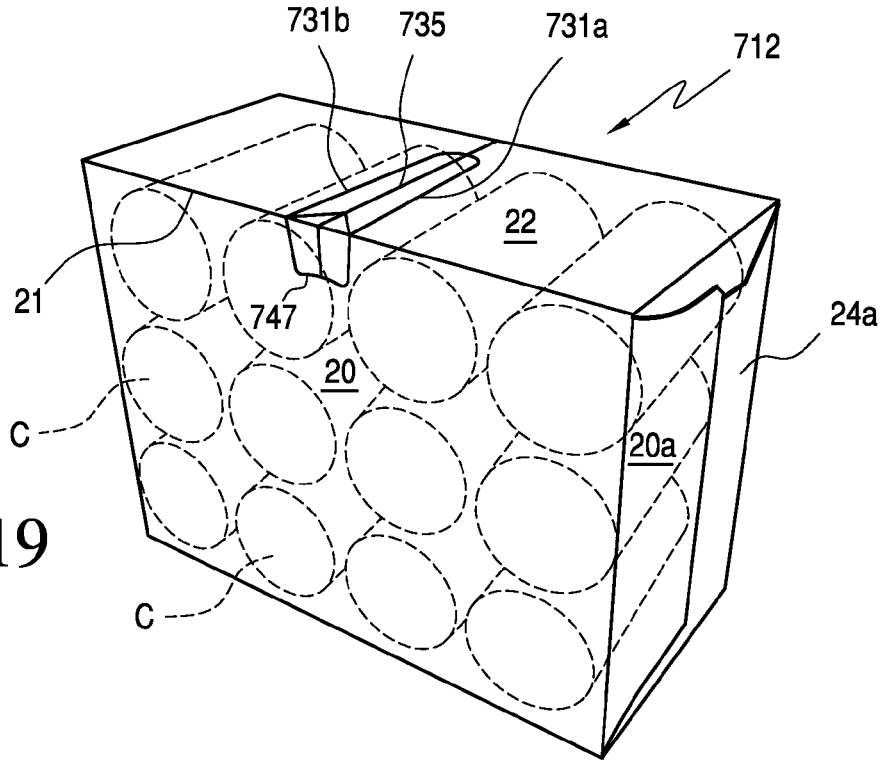
FIG. 19 is a perspective view of a carton formed from the blank of FIG. 18.

FIGS. 18 and 19 illustrate an eighth exemplary embodiment of the invention. The eighth embodiment will be described using reference numerals in a "700" series to identify features. For convenience of explanation, features that are similarly disposed or positioned as features in the exemplary embodiment of FIGS. 1-6 will be enumerated in the "700" series but with the same ending numerals as the FIGS. 1-6 counterparts. In FIGS. 18 and 19, environmental features of a blank 714 and a carton 712 that are similar to those of the embodiment shown in FIGS. 1-6 bear the identical numerals assigned to those features in FIGS. 1-6.

Referring now to FIG. 18, therein is shown in a plan view of the blank 714 for forming the carton 712 (see FIG. 19.) The blank 714 has an alternative carrying handle 730. The carrying handle 730 includes diagonally extending engaging edges or sides similar to the handle 30 of the first exemplary embodiment. The handle 730 is shown as integrally formed in portions of the top wall 22 and first side wall 20. The handle 730 includes a handle opening or slot 780 that is an opening that is formed in the top wall 22 and first side wall 20. The slot 780 may be initially occupied and subsequently vacated by a pair of foldable handle flaps 732 including primary portions 732*a*, 732*b* and webs associated therewith. The slot 780, and, in turn, each of the handle flaps 732, are formed in part by top wall fold lines 731*a*, 731*b* that extend substantially, but not entirely, across the width of the top wall 22 in a direction that is transverse to the direction of extension of side edges 21, 23 of the top wall 22. In the eighth exemplary embodiment, the top wall fold lines 731*a*, 731*b*, and hence the engaging edges or sides of the slot itself, diverge slightly as the top wall fold lines 731*a*, 731*b* extend toward the first side wall 20. The top wall fold lines 731*a*, 731*b* intersect a curvilinear slit 733 that defines a first end of the handle 730. The slit 733 may be releasably held closed by one or more connecting points in a similar way to the slit 33 in the first exemplary embodiment. This curvilinear slit 733, and hence the first end of the handle 730, is offset from the edge 23 of the top wall 22 along which the second side wall 24 is hingedly connected. A severance line segment 735*b* of the top wall medial severance line 735 extends entirely between the curvilinear slit 733 and the edge 23. Stated differently, the medial severance line 735 extends substantially entirely across the top wall 22 between the fold lines 21, 23. One end of the severance line segment 735*b* terminates on the side edge or fold line 23.

The top wall fold lines 731*a*, 731*b* intersect the fold line 21. A pair of opposing side wall fold lines 739*a*, 739*b* extends from the top wall fold lines 731*a*, 731*b* along a portion of the first side wall 20. The side wall fold lines 739*a*, 739*b* terminate at a cut line 747 that is similar to the cut line 247 in FIG. 8 or the cut line 347 in FIG. 9. The side wall fold lines 739*a*, 739*b* diverge slightly as they extend from the cut line 747 toward the fold line 21.

In this embodiment, two half size panels provide a composite bottom wall of the carton 712. A first bottom wall panel 26 is designed to be secured to a second bottom wall panel 28 to provide a composite bottom wall. The first bottom wall panel 26 serves as an outer layer of the composite bottom wall that is secured to the outside surface of the inner layer that is provided by the second bottom wall panel 28.

Referring now to FIG. 19, the carton 712 formed from the blank 714 is illustrated. As shown by the hidden lines, the carton 712 is designed to contain twelve cans "C" in a 3×4 configuration. In other words, the twelve cans in the carton 712 are arranged in three horizontal rows of four cans each. The three rows are stacked or vertically arranged to provide three tiers. The first side wall 20 is disposed alongside the ends of the cans "C". The top wall 22 is disposed over the rounded side walls of the cans in the uppermost row or tier. The carrying handle 730 is integrally formed in the top wall 22 and the first side wall 20. The first side wall 20 and the top wall 22 are foldably adjoined along the fold line 21. One closure end of the carton 712 with overlapping side end flaps 20*a*, 24*a* is disposed along the respective end cans "C" of the three rows. The top wall portion of the handle 730 is located over the space between two adjacent cans "C" in the uppermost row while the side wall portion of the handle 730 is in a substantial registry with the same space (that is defined by the top wall 22 and the two adjacent cans in the uppermost row.)

A longitudinal axis of each of the cans C is described as that which aligns with the ends of the cans C. In the illustrated embodiments, the ends of the cans C are adjacent the side walls 20, 24 and the longitudinal axes are substantially perpendicular to the side walls 20, 24. Alternatively described, the longitudinal axes of the cans C are substantially parallel with a fold line (such as fold lines 72, 74) that connect the top wall 22 or bottom wall 26 to the handled end wall 710. In the illustrated embodiments, the handles 30 are configured such that a longitudinal axis thereof extends between ends of the handle 30 or with respect to the elongation of the handle 30. The longitudinal axis of the handle 30 is substantially parallel to the longitudinal axes of the cans C. Alternatively described, the longitudinal axis of the handle 30 is substantially transverse with respect to the longitudinal axis of the carton 12 or with respect to the edges 21, 23 connecting the top wall 22 to the side walls 20, 24.

Figure 20:
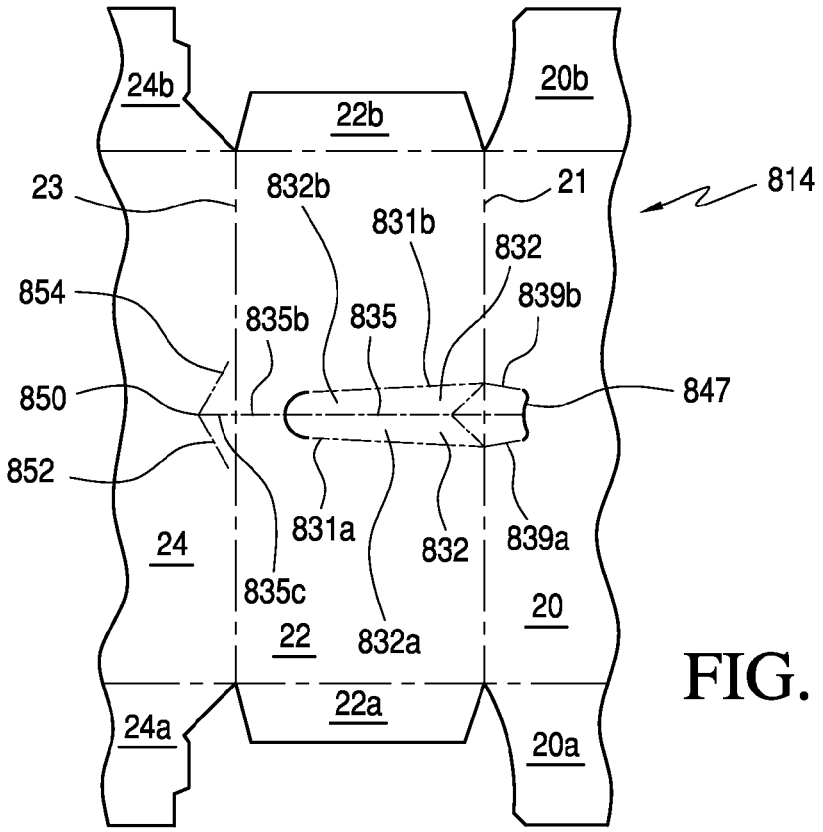
FIG. 20 is a fragmentary plan view of a blank suitable for forming a carton, according to a ninth exemplary embodiment.
Figure 21:
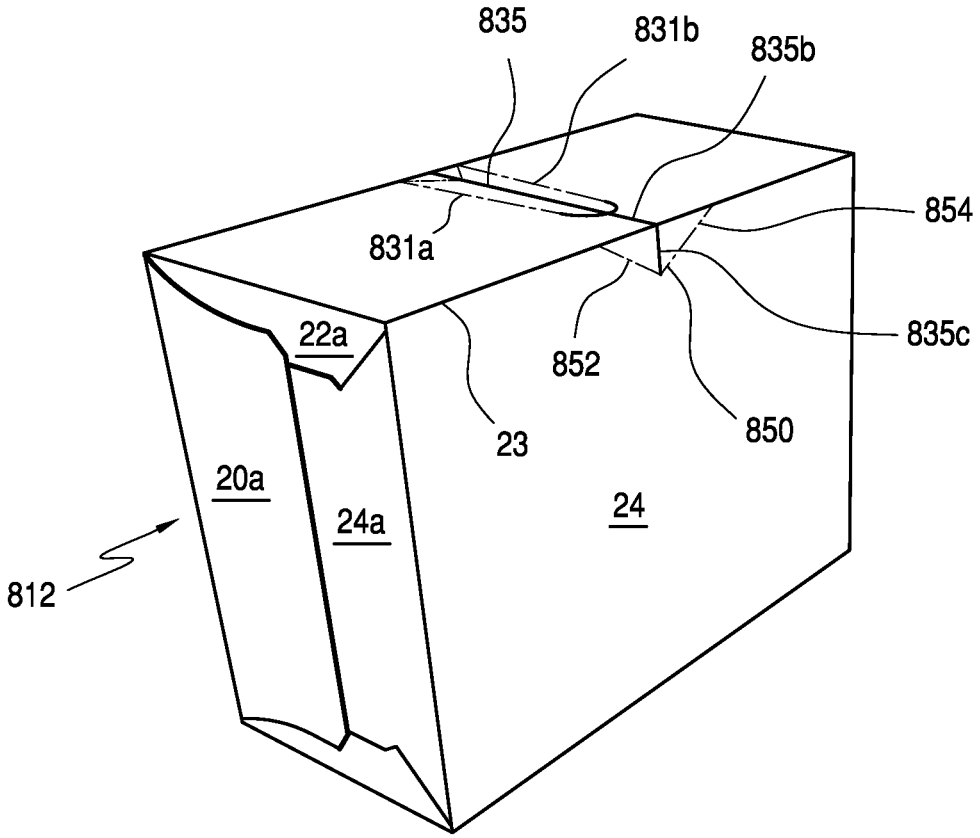
FIG. 21 is a perspective view of a carton formed from the blank of FIG. 20.

FIGS. 20 and 21 illustrate a ninth exemplary embodiment. The ninth embodiment will be described using reference numerals in an "800" series to identify features. For convenience of explanation, features that are similarly disposed or positioned as features in the exemplary embodiment of FIGS.

18 and 19 will be enumerated in the "800" series but with the same ending numerals as the FIGS. 18 and 19 counterparts. In FIGS. 20 and 21, environmental features of the blank 814 and carton 812 that are similar to those of the embodiment shown in FIGS. 18 and 19 bear the identical numerals assigned to those features in FIGS. 18 and 19.

Referring now to FIG. 20, therein is shown in a fragmentary plan view of a blank 814 for forming a carton 812 (see FIG. 21.) The blank 814 has an alternative carrying handle 830. The carrying handle 830 is similar to the handle 730 of the exemplary embodiment of FIGS. 18 and 19. Therefore, the only the features that differ from the handle 730 will be described herein below.

Referring to FIGS. 20 and 21, the medial severance line segment 835*b* is extended into the second side wall 24 to form an end projection 835*c* that is disposed substantially perpendicularly to the top wall 22 as viewed in FIG. 21. The length of the end projection 835*c* may be approximately twice the distance between the medial severance line 835 and one of the top wall fold lines 831*a*, 831*b*. At the terminal end of the end projection 835*c*, an arched terminal cut 850 is provided to reduce the chance of a tear developing from the terminal end of the end projection 835*c*. A pair of fold lines 852, 854 is formed in the second side wall 24 and extends from the terminal cut 850 divergently to the fold line 23 where the fold lines 852, 854 terminate.

The blanks 14, 214, 314, 414, 514, 614, 714, 814 and the cartons 12, 112, 312, 412, 512, 612, 712, 812 erected therefrom may be formed from any substrate suitable for folding and manipulation into the configurations described herein. It is to be understood that, as used herein the term "suitable substrate" includes all manner of foldable sheet material such as paperboard, corrugated board, plastic, or the like. The terms "fold line" and "severance line" used herein refer to all manner of printed lines indicating optimal fold or cut locations, frangible or otherwise weakened lines, perforations, a line of perforations, a line of short slits, a line of half-cuts, a single half-cut, a cut line, scored lines, slits, cuts or slits interspersed with connecting points any combination thereof, and the like.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A carton, comprising:
- a plurality of walls comprising a first wall and a second wall, the first wall comprising a first edge and a second edge that are opposed to one another, the first wall and the second wall being adjoined along the first edge; and
- a handle, comprising:
  - a handle opening in at least the first wall, the handle opening being elongated along a longitudinal axis that extends transversely to the first edge; and
  - a stress relief feature formed at least in the second wall and extending from the handle opening, wherein the stress relief feature comprises an undulating severance line, wherein the undulating severance line includes an S-shaped portion.

2. The carton of claim 1, wherein the handle opening comprises a pair of opposed ends at least one of the opposed ends being defined at least in part by a portion of the undulating severance line.

3. The carton of claim 2, wherein another portion of the undulating severance line extends away from the at least one of the opposed ends of the handle opening.

4. The carton of claim 1, wherein the handle opening is formed in the first wall and extends into the second wall so as to terminate in the second wall at one of opposed ends of the handle opening, the one of the opposed ends being defined at least in part by the undulating severance line.

5. The carton of claim 4, wherein the handle further comprises at least one handle flap that is hingedly connected to an edge of the handle opening so as to be connected to both the first wall and the second wall, the handle flap being configured to fold inwardly.

6. The carton of claim 5, wherein the handle flap comprises a web structure that is configured to facilitate folding the handle flap.

7. The carton of claim 5, wherein the handle flap comprises a first wall section that is hingedly connected to the first wall and a second wall section that is hingedly connected to the second wall, the first wall section being hingedly connected to the second wall section along the first edge, the handle flap further comprising a fold line extending at an angle with respect to the first edge, the fold line defining a web that facilitates folding of the first wall section with respect to the second wall section as the handle flap is inwardly folded.

8. The carton of claim 7, wherein the stress relief feature extends from a fold line along which the second wall section is hingedly connected to the second wall.

9. The carton of claim 1, wherein the undulating severance line extends from an end of the handle opening.

10. The carton of claim 1, wherein the handle opening is tapered along the longitudinal axis so as to widen towards the first edge.

11. The carton of claim 1, wherein the handle further comprises:
- first wall fold lines that intersect the first edge;
- second wall fold lines extending, respectively, from intersections of the first wall fold lines and the first edge,
- wherein the second wall fold lines terminate at the undulating severance line.

12. The carton of claim 1, wherein the undulating severance line is one selected from the group consisting of a line of perforations, a line of short slits, a line of half-cuts, a single half-cut, a cut line, and cuts interspersed with connecting points.

13. A package, comprising:
- a group of cylindrical articles arranged in rows and columns; each article comprising a longitudinal axis, opposed ends, and a side wall; and
- a carton configured to at least partially enclose the group of cylindrical articles, comprising:
  - a plurality of walls comprising a first wall and a second wall, the first wall being disposed adjacent the sidewalls of at least two of the articles and the second wall being disposed adjacent a first one of the opposed ends of each of the articles, the first wall comprising a first edge and a second edge that are opposed to one another, the first wall and the second wall being adjoined along the first edge; and
  - a handle, comprising:
    - a handle opening in at least the first wall, the handle opening being elongated along a longitudinal axis that extends transversely to the first edge, the handle opening being disposed to overlie the space between the sidewalls of the at least two of the articles; and a stress relief feature formed at least in the second wall and extending from the handle opening, the stress relief feature comprising an undulating severance line, wherein the undulating severance line includes an S-shaped portion.

14. The package of claim 13, wherein the handle opening comprises a pair of opposed ends, at least one of the opposed ends being defined at least in part by a portion of the undulating severance line.

15. The package of claim 14, wherein another portion of the undulating severance line extends away from the at least one of the opposed ends of the handle opening.

16. The package of claim 13, wherein the handle opening is formed in the first wall and extends into the second wall so as to terminate in the second wall at one of opposed ends of the handle opening.

17. The package of claim 16, wherein the handle further comprises at least one handle flap that is hingedly connected to an edge of the handle opening so as to be connected to the first wall along a first wall fold line and to the second wall along a second wall fold line, the handle flap being configured to fold inwardly, the first wall fold line intersecting with the first edge, the second wall fold line extending from an intersection of the first wall fold line and the first edge, and wherein the second wall fold line terminates at the undulating severance line.

18. The package of claim 13, wherein the undulating severance line is one selected from the group consisting of a line of perforations, a line of short slits, a line of half-cuts, a single half-cut, a cut line, and cuts interspersed with connecting points.

* * * * *